US005764266A

United States Patent [19]

Azuma et al.

[11] Patent Number: 5,764,266

[45] Date of Patent: Jun. 9, 1998

[54] APPARATUS FOR PRINTING IMAGE DATA

[75] Inventors: Takeo Azuma; Atsushi Morimura, both of Nara; Kazuhiro Kayashima; Kenya Uomori, both of Hirakata; Yasuo Fukui, Kadoma; Hiroshi Onishi, Hirakata; Kouji Ikeda, Katano, all of Japan

[73] Assignee: Matsushita Electric Industrial Co., Ltd, Kadoma, Japan

[21] Appl. No.: 644,502

[22] Filed: May 10, 1996

[30] Foreign Application Priority Data

May 11, 1995 [JP] Japan ..... 7-112897
May 9, 1996 [JP] Japan ..... 8-114489

[51] Int. Cl.[6] ..... B41J 2/32; B41J 2/325

[52] U.S. Cl. ..... 347/171; 347/218

[58] Field of Search ..... 347/171, 215, 347/218

[56] References Cited

U.S. PATENT DOCUMENTS 4,394,083 7/1983 Rees .
5,001,515 3/1991 Nomura et al. .
5,267,002 11/1993 Maitani et al. .

FOREIGN PATENT DOCUMENTS 5265107 10/1993 Japan .
652291 2/1994 Japan .
6340099 12/1994 Japan .
713275 1/1995 Japan .

*Primary Examiner*—Huan H. Tran
*Attorney, Agent, or Firm*—Renner, Otto, Boisselle, Sklar

[57] ABSTRACT

An apparatus for printing image data prints image data on a lens array having a plurality of lenses arranged along a first direction. The apparatus includes: an image data generating section for generating image data; a head having a plurality of printing elements arranged along a second direction, the head driving each of the plurality of printing elements in accordance with the image data; a conveying section for conveying the lens array relative to the head; and a first pinion and a second pinion which are arranged along the second direction. The first pinion and the second pinion each have a rotation axis parallel to the second direction. The lens array has a first rack extending along the first direction and a second rack extending along the first direction. The first pinion engaging with the first rack of the lens array and the second pinion engaging with the second rack of the lens array.

16 Claims, 25 Drawing Sheets

APPARATUS FOR PRINTING IMAGE DATA

BACKGROUND OF THE INVENTION

1. Field of the Invention

The present invention relates to an apparatus for printing image data, and in particular to a three-dimensional (3D) image printing apparatus for printing a multi-view point image on a lens array, the image having been filmed or photographed in a plurality of directions.

2. Description of the Related Art

Conventional 3D image printing techniques include those which employ films, e.g., holography techniques and a method for printing an image taken by a plurality of cameras on a photosensitive material provided behind a lenticular lens, the image being projected from the front side (i.e., the side of the lenticular lens which is viewed by a viewer) of the lenticular lens. Another type of conventional 3D image printing technique includes a printing apparatus disclosed in Japanese Laid-Open Patent Publication No. 6-340099, which prints a multi-view point image on the back face of a lenticular lens (i.e., the side of the lenticular lens opposite to where a viewer is positioned).

FIG. 23 illustrates the configuration of a conventional printing apparatus disclosed in Japanese Laid-Open Patent Publication No. 6-340099. Hereinafter, the operation of this printing apparatus will be described with reference to FIG. 23.

Image data taken by electronic still cameras 120 and 121 is processed by an image processing section 119 in such a manner that an image R for the right eye of a viewer (hereinafter referred to as a "right-eye image") and an image L for the left eye of the viewer (hereinafter referred to as a "left-eye image") are synthesized so as to alternate in position when printed on the back face of the lenticular lens, as illustrated in FIG. 3.

A printer body 118 writes data synthesized by the image processing section 119 in a memory 117. A motor 112 drives a roller 110 in a direction indicated as by 2 in FIG. 23.

A light emitting element 115 and a photosensitive element 111 detect the locations of the concave portions and convex portions of a lenticular lens 101 relative to a printing head 114. Thus, one vertical line of either a right-eye image or a left-eye image is printed each time so as to occupy one-half of the width of one stripe of the lenticular lens 101.

FIG. 24 is a view illustrating the printing apparatus in FIG. 23 from a direction along which the lenticular lens 101 is fed to the apparatus.

In FIG. 24, reference nemerals 111*a* and 111*b* represent photosensitive elements (line sensors) for detecting the convex portions and the concave portions of the lenticular lens 101 at the upper and lower ends of the lenticular lens 101, respectively. Reference numerals 115*a* and 115*b* represent light emitting elements which cooperate with the line sensors 111*a* and 111*b*, respectively.

FIGS. 25A and 25B are views illustrating the principle of detection of the concave portions and convex portions of the lenticular lens 101 by the line sensor 111. As seen from FIGS. 25A and 25B, light emitted from the light emitting element 115 is received in different positions by the line sensor 111 in accordance with the position of the lenticular lens 101 relative to the light emitting elements 115 which is attached on the printing head 114. Accordingly, the position in which the light is received changes as the lenticular lens 101 travels along its path. Thus, the relative position of the lenticular lens 101 with respect to the printing head 114 can be detected.

Among the above-mentioned conventional techniques, however, those which employ a film have the problems of an increased scale of the apparatus and inability to display or view an image immediately after the image is taken by cameras, etc. Furthermore, it is difficult with those techniques to quickly and easily output a computer graphics (CG) image or a real image synthesized with a CG image as a 3D image.

On the other hand, methods for printing an image on the back face of a lenticular lens require a complicated detection mechanism using line sensors to detect the position of the lenticular lens relative to a printing head. Moreover, since these techniques detect the position of the lenticular lens relative to the printing head at the upper end and the lower end of the lenticular lens, an offset may occur, which is equal to a multiple of the pitch of the lenticular lens, between the upper and lower end of the lenticular lens, as illustrated in FIG. 20A. Similarly, when overlaying a plurality of images for color printing, the respective data of cyan, magenta, and yellow for the same coordinates may have an offset, which is equal to a multiple of the pitch of the lenticular lens, along the horizontal direction with respect to one another.

SUMMARY OF THE INVENTION

The present invention provides an apparatus for printing image data on a lens array having a plurality of lenses arranged along a first direction. The apparatus includes: an image data generating section for generating image data; a head having a plurality of printing elements arranged along a second direction, the head driving each of the plurality of printing elements in accordance with the image data; a conveying section for conveying the lens array relative to the head; and a first pinion and a second pinion which are arranged along the second direction. The first pinion and the second pinion each have a rotation axis parallel to the second direction. The lens array has a first rack extending along the first direction and a second rack extending along the first direction. The first pinion engages with the first rack of the lens array and the second pinion engages with the second rack of the lens array.

In one embodiment of the invention, the conveying section includes a roller rotating around a rotation axis, at least a portion of the roller being in contact with the lens array.

In another embodiment of the invention, the roller is rotated so that back tension is created between the roller and the lens array.

In still another embodiment of the invention, the rotation axis of the first pinion and the rotation axis of the second pinion are identical with the rotation axis of the roller.

In still another embodiment of the invention, the apparatus further includes: a third pinion and a fourth pinion arranged along the second direction, the third pinion and the fourth pinion each having a rotation axis parallel to the second direction. The lens array includes a third rack extending along the first direction and a fourth rack extending along the first direction. The third pinion engages with the third rack of the lens array and fourth pinion engages with the fourth rack of the lens array. A pitch of the third pinion is larger than a pitch of the first pinion, and a pitch of the fourth pinion is larger than a pitch of the second pinion.

In still another embodiment of the invention, the pitch of the third pinion is larger than 1.5. times the pitch of the first pinion, and the pitch of the fourth pinion is larger than 1.5 times the pitch of the second pinion.

In still another embodiment of the invention, the third pinion is located upstream of the first pinion along a direction in which the lens array is conveyed, and the fourth pinion is located upstream of the second pinion along the direction in which the lens array is conveyed.

In still another embodiment of the invention, the apparatus further includes: a detecting section for detecting a position of the lens array relative to a position of the head. The image data generated by the image data generating section includes a first portion and a second portion, the image data generating section selectively outputting the first portion or the second portion included in the image data in accordance with an output of the detecting section.

In still another embodiment of the invention, the apparatus further includes: a maintaining section for maintaining the engagement between the first pinion and the first rack of the lens array and the engagement between the second pinion and the second rack of the lens array irrespective of a position of the head.

In still another embodiment of the invention, the maintaining section includes a first member and a second member which are fixed with respect to the lens array, the lens array being interposed between the first member and the first pinion and between the second member and the second pinion.

In another embodiment of the invention, the image data is image data which is obtained by taking images in a virtual manner or in an actual manner.

In still another embodiment of the invention, the lens array includes a dyeing layer, and the head causes ink of an ink sheet to adhere to the dyeing layer of the lens array.

In still another embodiment of the invention, a back substrate is applied onto a back face of the lens array after the image data is printed on the lens array, thereby intercepting light transmitted through the lens array from the back face when the lens array is observed.

In still another embodiment of the invention, the lens array is integrally formed of a dyeable material.

In still another embodiment of the invention, the dyable material includes at least one of an acrylic resin, a vinyl chloride resin and a butyral resin.

Alternatively, the apparatus includes: an image data generating section for generating image data; a head having a plurality of printing elements arranged along a second direction, the head driving each of the plurality of printing elements in accordance with the image data; a conveying section for conveying the lens array relative to the head; a pinion having a rotation axis parallel to the second direction; and a pressuring section for pressuring the lens array along the second direction. The lens array includes a rack extending along the first direction. The pinion engages with the rack of the lens array.

Thus, the invention described herein makes possible the advantage of providing an apparatus of a moderate scale, relative to conventional apparatuses of the same, for easily and quickly printing a real image, a CG image, a synthesized image containing both, or an intermediate image generated from a real image (i.e., an image representing an inferred image between a left image and a right image) as a 3D image.

This and other advantages of the present invention will become apparent to those skilled in the art upon reading and understanding the following detailed description with reference to the accompanying figures.

DESCRIPTION OF THE PREFERRED EMBODIMENTS

(EXAMPLE 1)

A 3D image printing apparatus 100 according to the present invention prints image data on a light path changing element 8. The light path changing element 8 includes a face 201 and a face 202.

Figure 1A:
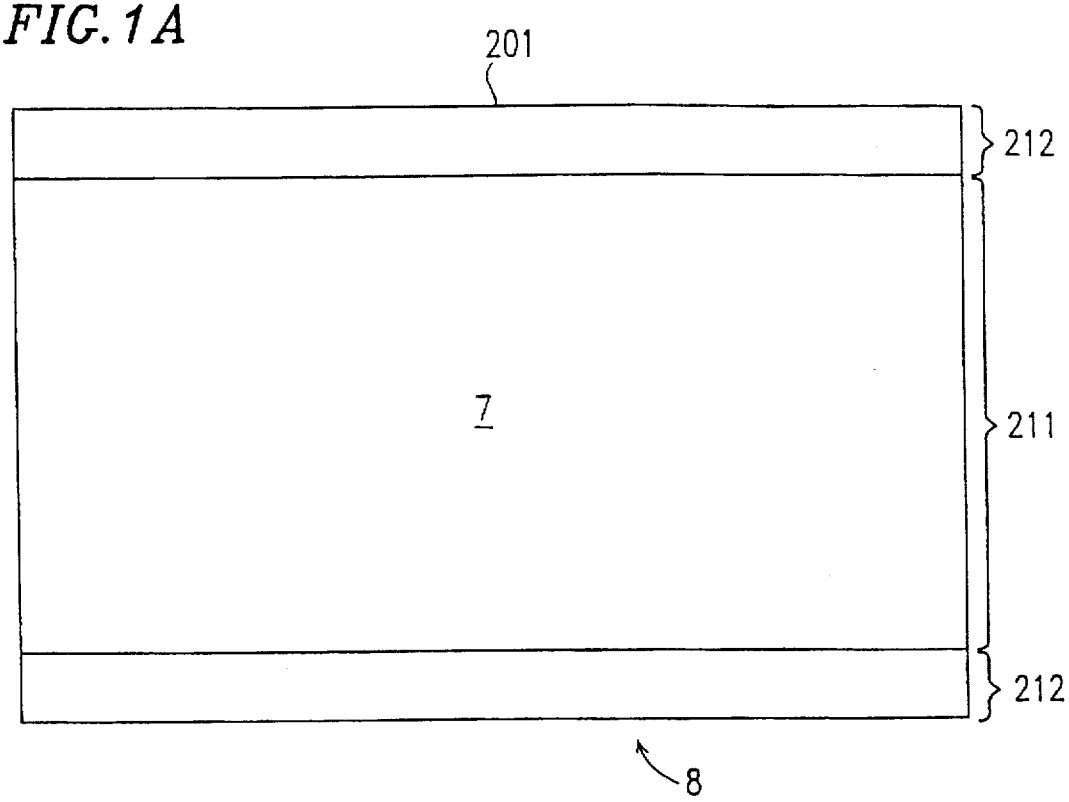
FIG. 1A is a view illustrating one face of a light path changing element.

FIG. 1A illustrates the face 201 of the light path changing element 8. The face 201 of the light path changing element 8 includes a region 211 in which image data is to be printed and regions 212 in which no image data is to be printed (hereinafter also referred to as "no-picture portions"). A dyeing layer 7 is formed in the region 211 of the face 201.

Figure 1B:
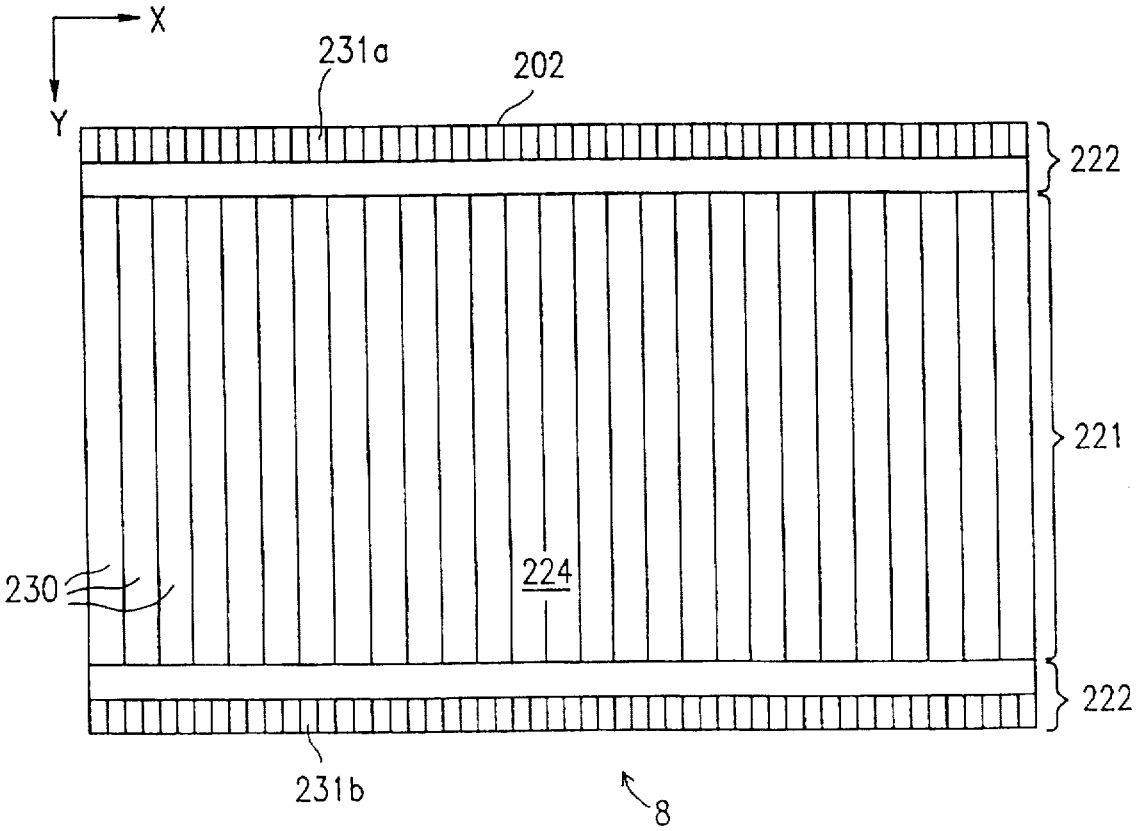
FIG. 1B is a view illustrating an opposite face of the light path changing element.

FIG. 1B illustrates the face 202 of the light path changing element 8. The face 202 of the light path changing element 8 includes regions 211 and 222, which correspond to the regions 211 and 212 of the face 201, respectively.

A lens array 224 is formed in the region 221 of the face 202. The lens array 224 includes a plurality of lenses 230 arranged along an X direction. Each lens 230 extends along a Y direction which is perpendicular to the X direction. Each lens 230 has a cross section forming a convex shape along the X direction. Accordingly, the lens array 224 of the light path changing element 8 has a cross section with concave portions and convex portions periodically located along the X direction. The present specification will recite this structure of the lens array 224 as a "stripe structure" hereinafter. One pitch of the stripe structure of the lens array 224 is defined as the distance between two adjoining concave portions of the lens array 224 of the light path changing element 8, the distance being measured along the X direction.

In the respective regions 222 of the face 202, a rack 231*a* extending along the X direction and a rack 231*b* extending along the x direction are formed.

The light path changing element 8 having the structure illustrated in FIGS. 1A and 1B can be obtained, for example, by forming the dyeing layer 7 on one face of a lenticular lens and forming the racks 231*a* and 231*b* on the other face of the lenticular lens.

Figure 2A:
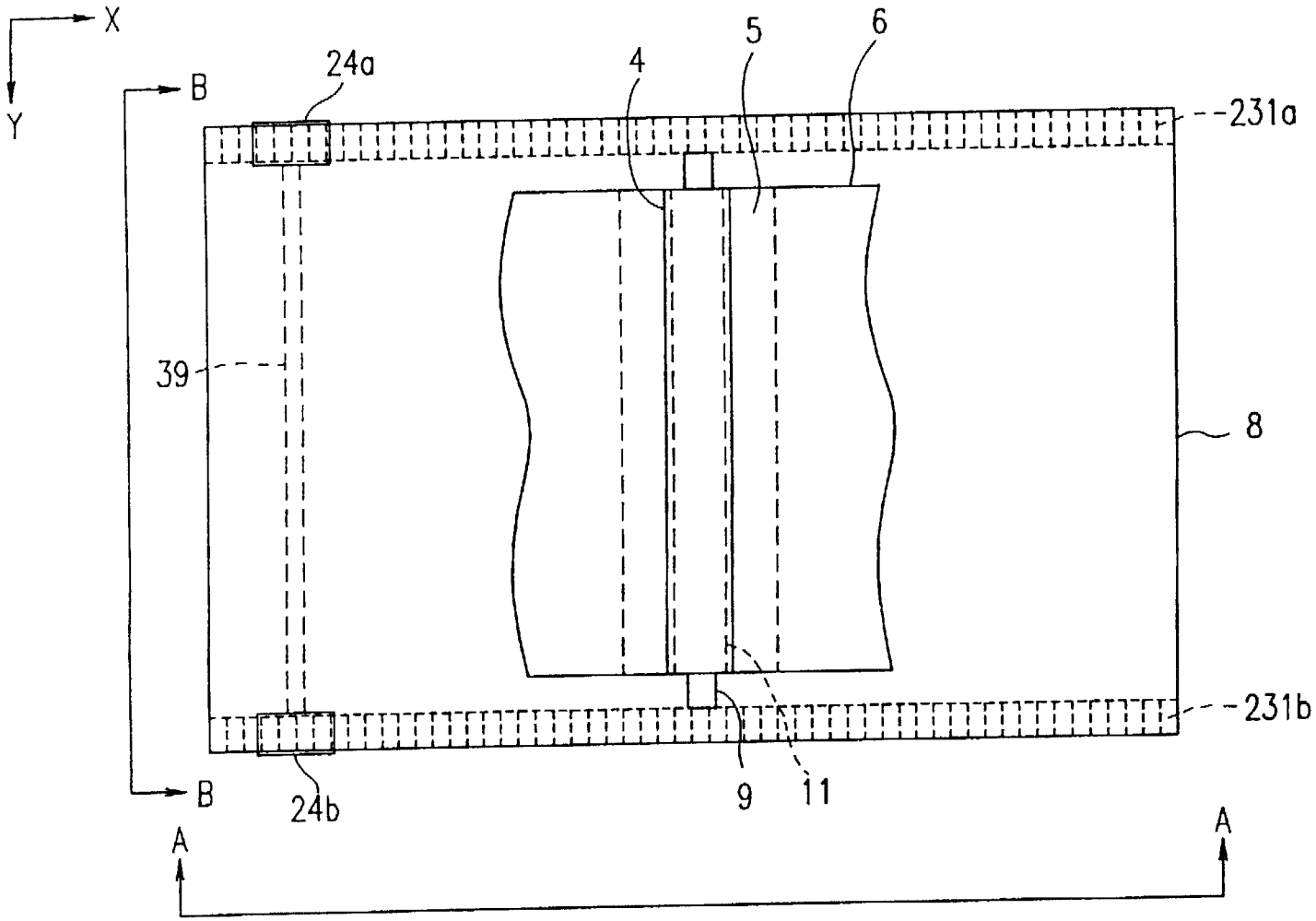
FIG. 2A is a plan view illustrating a light path changing element 100 according to the present invention.

FIG. 2A is a plan view illustrating the 3D image printing apparatus 100 according to the present invention. As illustrated in FIG. 2A, and 3D image printing apparatus 100 includes a printing head 4, a roller 5, a light emitting section 9, a roller driving section 11, and pinions 24*a* and 24*b*.

The printing head 4 includes a plurality of printing elements (not shown) arranged along the Y direction. The printing head 4 drives each printing element in accordance with image data. By transferring ink of a thermal transfer sheet 6 to the dyeing layer 7 of the light path changing element 8 by means of the printing elements of the printing head 4, image data is printed on the light path changing element 8.

At least a portion of the roller 5 contacts with the lens array 224 of the light path changing element 8. The roller 5 slides the thermal transfer sheet 6 and the light path changing element 8 including the dyeing layer 7 along the X direction as required by the desired printing result. As a result, the light path changing element 8 is conveyed along the X direction.

Figure 2B:
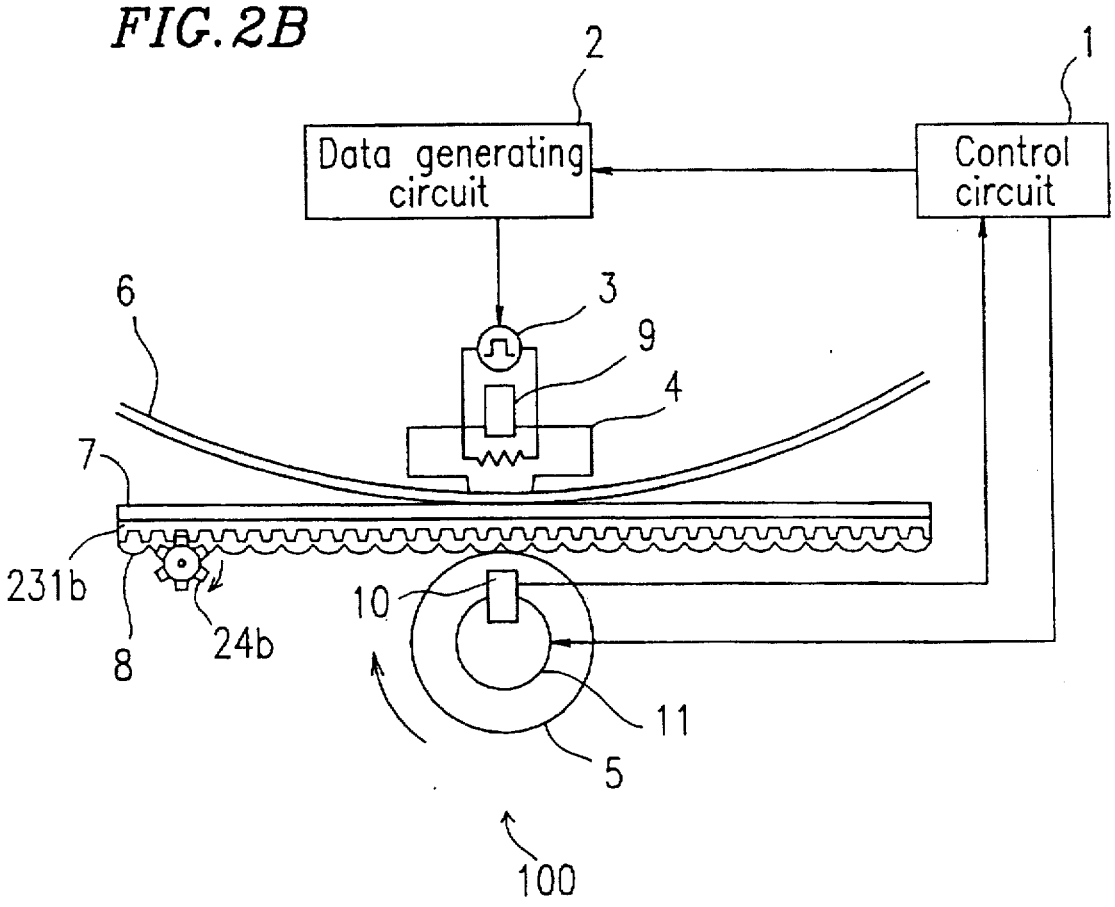
FIG. 2B is a side view illustrating a light path changing element 100 according to the present invention.

The light emitting section 9 cooperates with a light receiving section 10 (shown in FIG. 2B). Light emitted from the light emitting section 9 enters the light receiving section 10 via the lens array 224 of the light path changing element 8. The light emitting section 9 and the light receiving section 10 are employed to adjust the position on the light path changing element 8 where given image data is to be printed.

The roller driving section 11 drives the roller 5. The roller 5 has a rotation axis extending along the y direction, around which the roller 5 rotates.

The pinions 24*a* and 24*b* each have a rotation axis extending along the Y direction, around which the pinons 24*a* and 24*b* rotate. The pinions 24*a* and 24*b* are arranged along the Y direction in such a manner that the pinion 24*a* engages with the rack 231*a* formed on the face 202 of the light path changing element 8 and the pinion 24*b* engages with the rack 231*b* formed on the face 202 of the light path changing element 8. As a result of the engagement between the pinion 24*a* and the rack 231*a* and the engagement between the pinion 24*b* and the rack 231*b*, it is ensured that the vertical direction of the light path changing element 8 (i.e., the direction in which one pitch of the stripe of the lens array 224 extends) coincides with one vertical line to be printed by the printing head 4.

FIG. 2B is a side view illustrating the 3D image printing apparatus 100 as viewed from a A—A direction in FIG. 2A. However, FIG. 2B does not represent the actual physical shapes and arrangement of a control circuit 1 and a data generating circuit 2 because the physical shapes and arrangement of the control circuit 1 and the data generating circuit 2 are irrelevant to the nature of the present invention.

The 3D image printing apparatus 100 includes: the control circuit 1 for controlling the data generating circuit 2 and the roller driving section 11; the data generating circuit 2 for generating a parallax image (in which images taken in a plurality of directions are arranged so as to alternate along the horizontal direction); and a pulse generating circuit 3 for outputting pulses of different time widths depending on the image data generated by the data generating circuit 2. The printing head 4 is driven in accordance with the time width of the pulses output from the pulse generating circuit 3.

Hereinafter, the operation of the 3D image printing apparatus 100 having the above-described configuration will be described.

The light receiving section 10 detect convex portions of the lens array 224 of the light path changing element 8, and outputs a convex portion detecting signal to the control circuit 1. The convex portion detecting signal indicates the position of a detected convex portion.

The control circuit 1 generates an L/R read signal based on the convex portion detecting signal, and outputs the L/R read signal to the data generating circuit 2.

Figure 17:
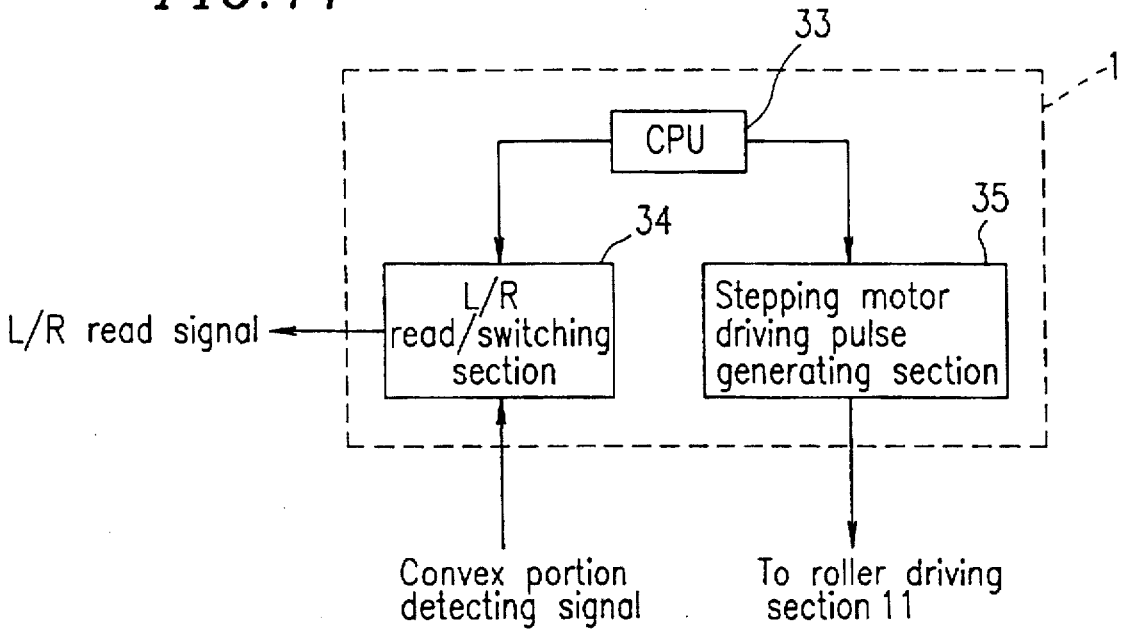
FIG. 17 is a diagram illustrating the configuration of a control circuit 1 illustrated in FIG. 2B.

FIG. 17 illustrates an exemplary configuration for the control circuit 1. As illustrated in FIG. 17, the control circuit 1 includes a CPU 33, and L/R read/switching section 34 and a stepping motor driving pulse generating section 35.

The CPU 33 outputs an operation control signal indicating the beginning or the end of an operation to the L/R read/switching section 34 and the stepping motor driving pulse generating section 35.

The data generating circuit 2 generates image data and sequentially transfers the generated image data to the pulse generating circuit 3. For example, the data generating circuit 2 generates a parallax image as image data. A parallax image is defined as an image in which images taken (actually or virtually) in a plurality of directions (e.g., two directions) are arranged so as to alternate along the horizontal direction. For example, when an image of an object is taken in both an L direction and an R direction, the data generating circuit 2 generates a parallax image in which an image signal L representing the image taken in the L direction and an image signal R representing the image taken in the R direction alternate along the horizontal direction, as illustrated in FIG. 3.

Figure 4:
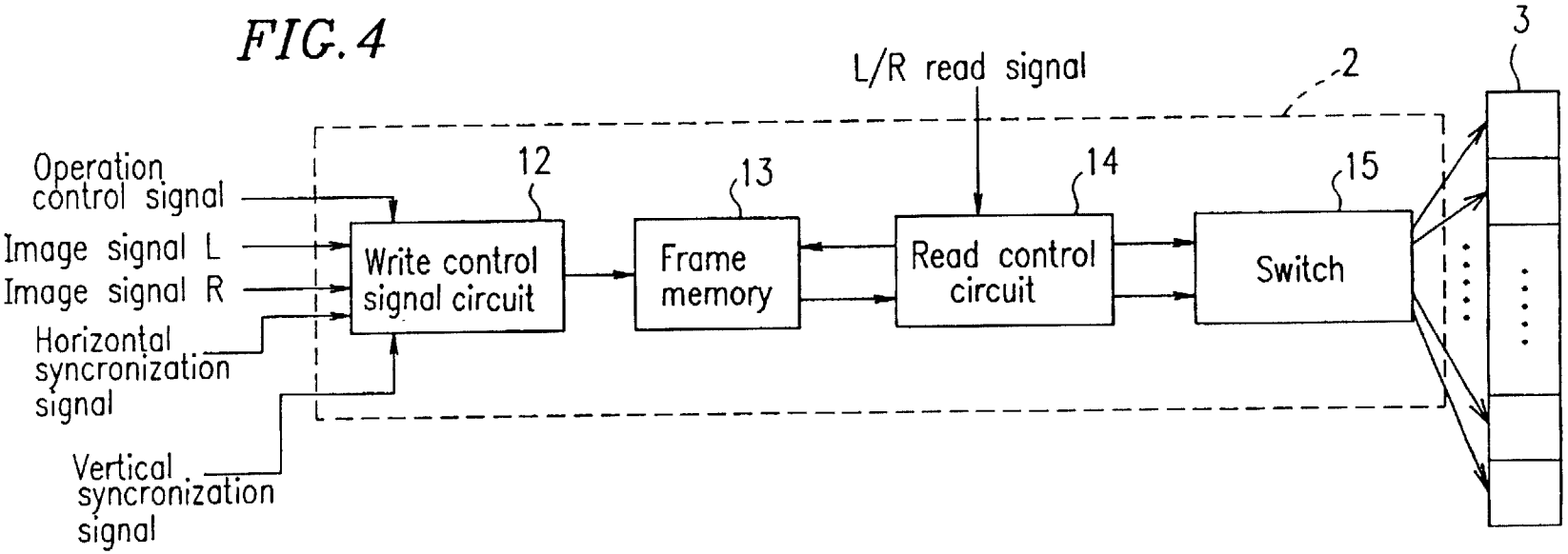
FIG. 4 is a diagram illustrating the configuration of a data generating circuit 2 illustrated in FIG. 2B.

FIG. 4 illustrates an exemplary configuration for the data generating circuit 2. As illustrated in FIG. 4, the data generating circuit 2 includes a write control signal circuit 12, a frame memory 13, a read control circuit 14, and a switch 15.

Figure 5:
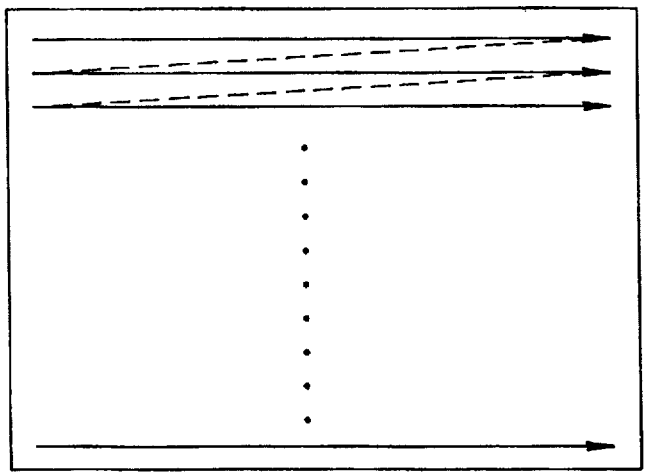
FIG. 5 is a diagram illustrating horizontal scanning.

The write control signal circuit 12 states its operation in response to the operation control signal from the control circuit 1. The write control signal circuit 12 counts a horizontal synchronization signal and a vertical sychronization signal for the image signals L and R each, and determines addresses. Thus, the write control signal circuit 12 alternately writes the values of the image signals R and L in the frame memory 13, according to the frame scanning order illustrated in FIG. 5.

Figure 3:
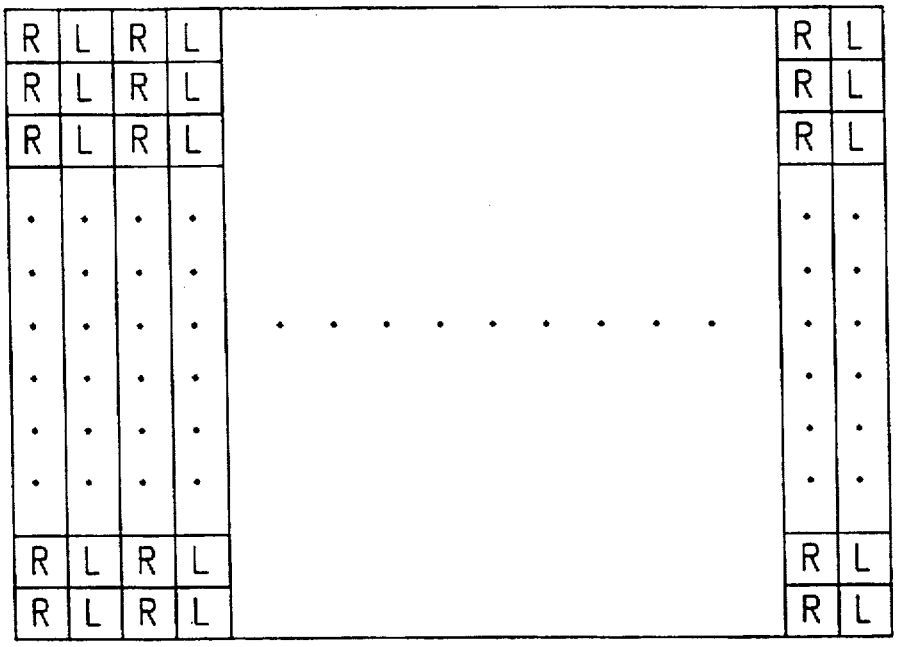
FIG. 3 is a diagram illustrating an example of a double-eye type parallax image.

Through the above operation, data, including the image signals R and L alternating along the horizontal direction as illustrated in FIG. 3, is written in the frame memory 13.

Figure 9:
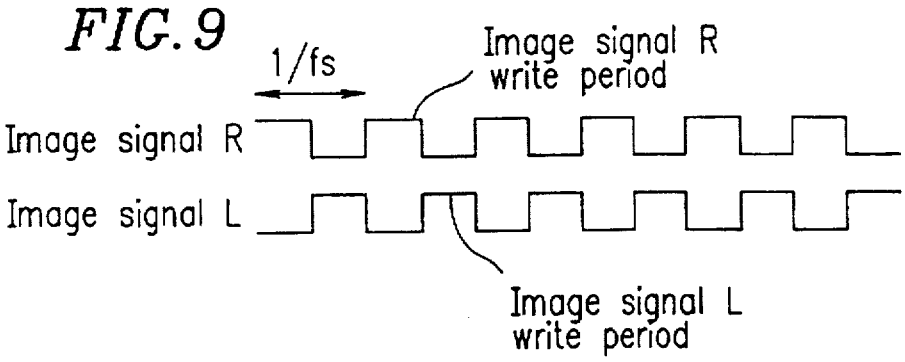
FIG. 9 is a timing diagram illustrating the timing of writing a left-eye image signal L and a right-eye image signal R in a frame memory 13 illustrated in FIG. 4.

FIG. 9 is a timing diagram illustrating the operation of the write control signal circuit 12 for alternately writing data of the image signals R and L.

In FIG. 9, fs represents a sampling frequency for the image signals R and L. The image signals R and L are alternately written in the frame memory 13 over a period of 1/2fs per pixel.

Figure 6:
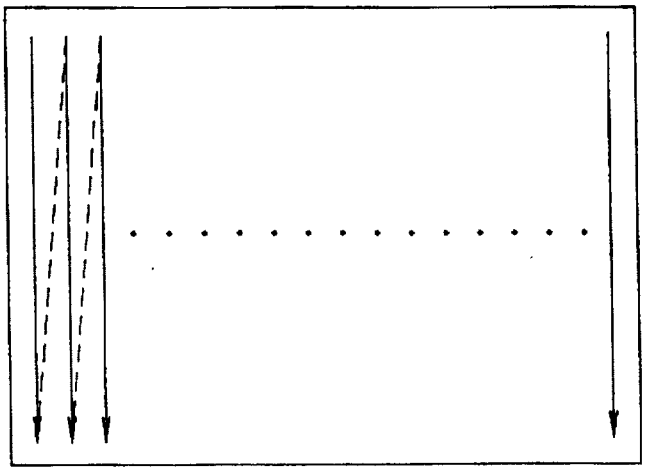
FIG. 6 is a diagram illustrating vertical scanning.

The read control circuit 14 sequentially reads one vertical line of data in response to the L/R read signal, as illustrated in FIG. 6, and sequentially outputs data to a destination designated by the switch 15, thereby outputting one vertical line of data to the pulse generating circuit 3.

Figure 7:
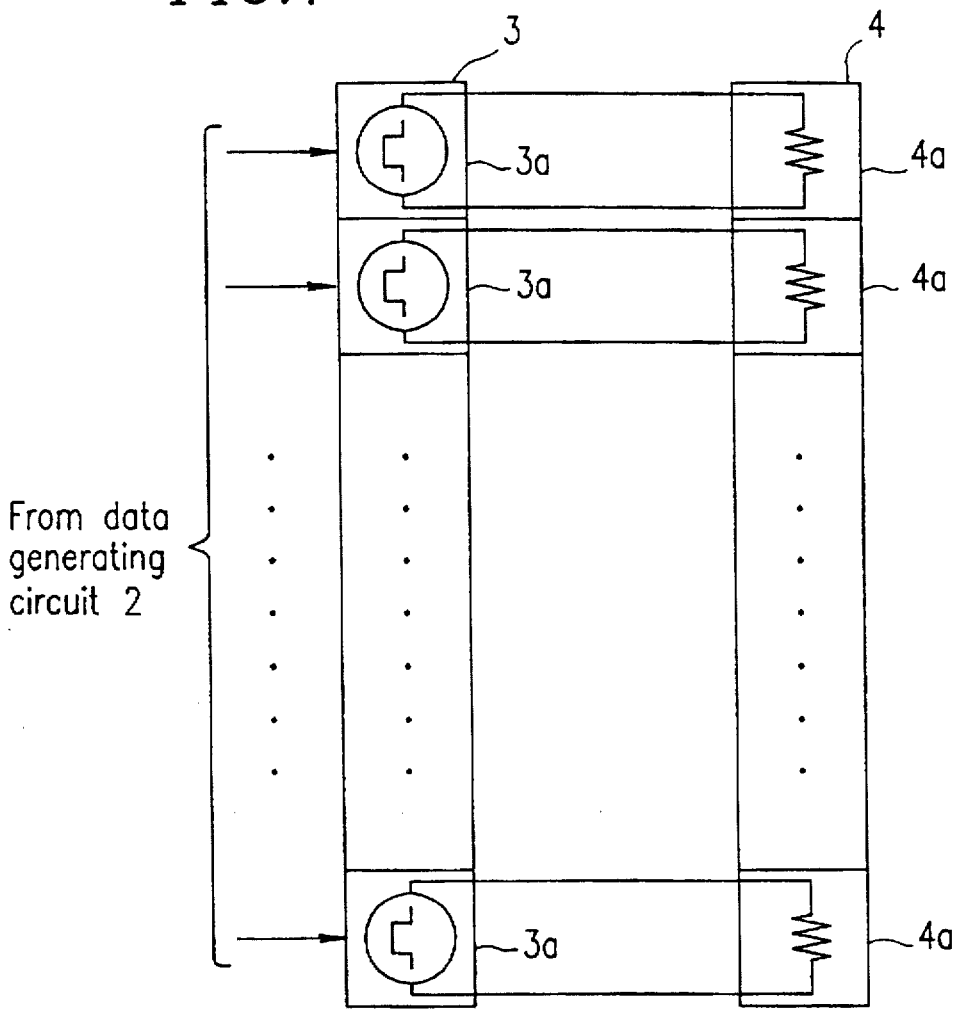
FIG. 7 is a diagram illustrating a manner in which a pulse generating circuit 3 and a printing head 4 in FIG. 2B are connected to each other.

FIG. 7 illustrates the manner in which the pulse generating circuit 3 and the printing head 4 are connected to each other.

The pulse generating circuit 3 includes a plurality of pulse generators 3*a*corresponding to one vertical line. Each pulse generator 3*a* generates pulses of different time widths depending on the input data.

The printing head 4 includes a plurality of thermal elements 4*a*. Each thermal element 4*a* is connected to a corresponding one of the pulse generators 3*a*, and is driven in accordance with the time widths of the pulses generated by that pulse generator 3*a*. As a result, the ink of the thermal transfer sheet 6 is transferred to the dyeing layer 7 of the light path changing element 8 with an amount of heat corresponding to the time width of the pulses.

Figure 8A:
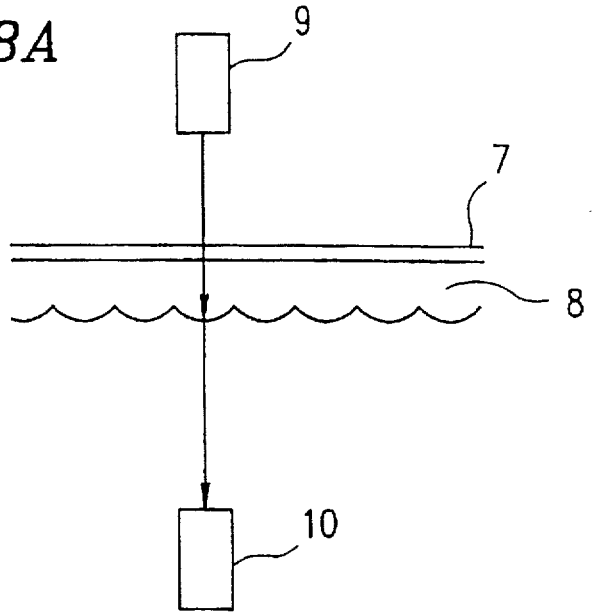
FIG. 8A is a diagram illustrating the principle of detecting convex portions of a light path changing element 8 (of a transmission type) by using a light emitting section 9 and a light receiving section 10 illustrated in FIG. 2B.
Figure 8B:
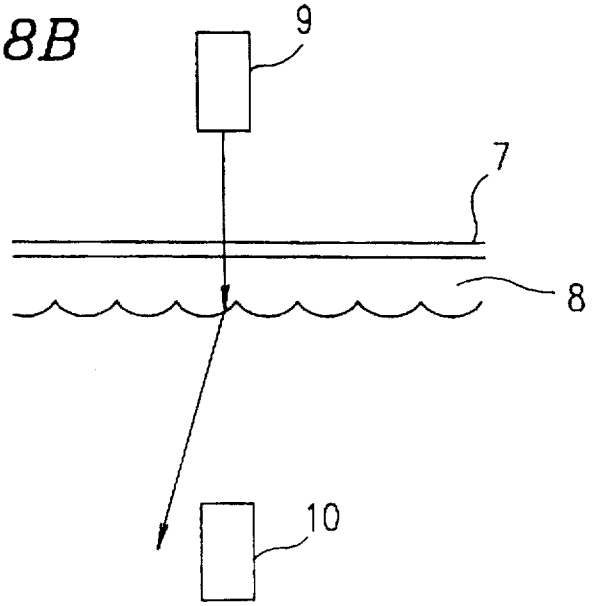
FIG. 8B is a diagram illustrating the principle of detecting convex portions of a light path changing element 8 (of a transmission type) by using a light emitting section 9 and a light receiving section 10 illustrated in FIG. 2B.

FIGS. 8A and 8B illustrate the principle of positioning of the light path changing element 8 relative to the position of the printing head 4 using the light emitting section 9 and the light receiving section 10.

Specifically, FIG. 8A illustrates a state where the light receiving section 10 and the light emitting section 9 are positioned on an optical axis of the light path changing element 8. In this state, the light receiving section 10 receives the light from the light emitting section 9 at the largest intensity.

FIG. 8B illustrates a state where the light receiving section 10 and the light emitting section 9 are not positioned on an optical axis of the light path changing element 8. In this state, the light receiving section 10 does not receive any light from the light emitting section 9.

Accordingly, by detecting the peak values of the level of light received by the light receiving section 10, the convex portions of the light path changing element 8 can be detected.

By switching image data for printing at a cycle which is half of the cycle of the detected convex portions, the 3D image printing apparatus 100 prints a right-eye image signal R and a left-eye image signal L within one pitch of the stripes of the light path changing element 8.

Figure 18:
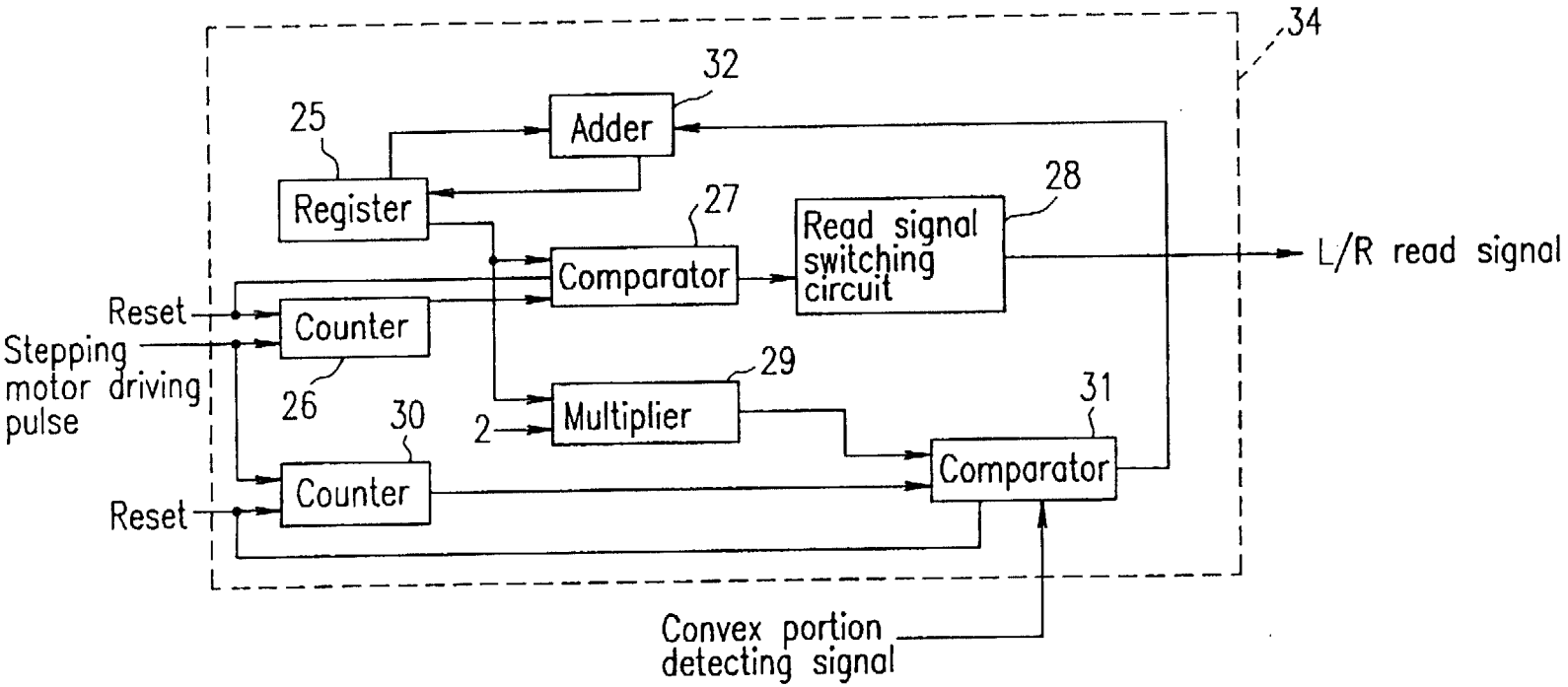
FIG. 18 is a diagram illustrating the configuration of an L/R read/switching circuit section 34 illustrated in FIG. 17.

FIG. 18 illustrates an exemplary configuration of the L/R read/switching section 34, which switches the image data for printing at a cycle which is a half of the cycle of the detected convex portions.

As illustrated in FIG. 18, the L/R read/switching section 34 includes: a register 25 for holding the number of pulses for driving a stepping motor (hereinafter referred to as "stepping motor driving pulses"), which correspond to the read switching cycle; a counter 26 for counting the number of stepping motor driving pulses; a comparator 27; a read signal switching circuit 28; a multiplier 29; a counter 30 for counting the number of stepping motor driving pulses between one detected convex portion and its subsequent detected convex portion; a comparator 31 for outputting either −1, 0, or 1 depending on the relationship between the output of the multiplier 29 and the value of the counter 30; and an adder 32.

Hereinafter, the operation of the L/R read/switching section 34 having the above configuration will be described.

The register 25 holds the number of stepping motor driving pulses corresponding to the read switching cycle.

The counter 26 counts the number of stepping motor driving pulses.

The comparator 27 compares the value of the register 25 and the value of the counter 26, and outputs the comparison result to the read signal switching circuit 28.

The comparator 27 resets the counter 26 to zero when the value of the counter 26 equals or exceeds the value of the register 25.

The read signal switching circuit 28 inverts the L/R read signal when the comparison result of the comparator 27 indicates that the value of the counter 26 equals or exceeds the value of the register 25, thereby switching the reading of image signals from L to R, or from R to L.

The counter 30 counts the number of stepping motor driving pulses between one detected convex portion of the light path changing element 8 and its subsequent convex portion.

The multiplier 29 doubles the value of the register 25.

The comparator 31 compares the value of the counter 30 and the output value of the multiplier 29 when detecting a convex portion of the light path changing element 8, and outputs "1" if the output of the multiplier 29 is smaller; outputs "0" if the two values are equal; or outputs "−1" if the output value of the multiplier 29 is larger. The comparator 31 then resets the value of the counter 30 to zero.

The adder 32 adds the output of the comparator 31 to the value of the register 25, thereby updating the value of the register 25.

The above operation switches data with an accuracy within the range of ±1 pulse with respect to the period of the detected convex portions of the light path changing element 8.

Therefore, by increasing the number of stepping motor driving pulses corresponding to 1 pitch of the light path changing element 8 (i.e., by decreasing the rotation angle of the roller 5 per 1 pulse, infra), it becomes possible to attain data switching with a desired accuracy.

The roller driving section 11 rotates the roller 5 with the stepping motor driving pulses from the control circuit 1. Specifically, the driving of the roller 5 is achieved by rotating the roller 5 by a predetermined angle for each pulse.

Figure 10:
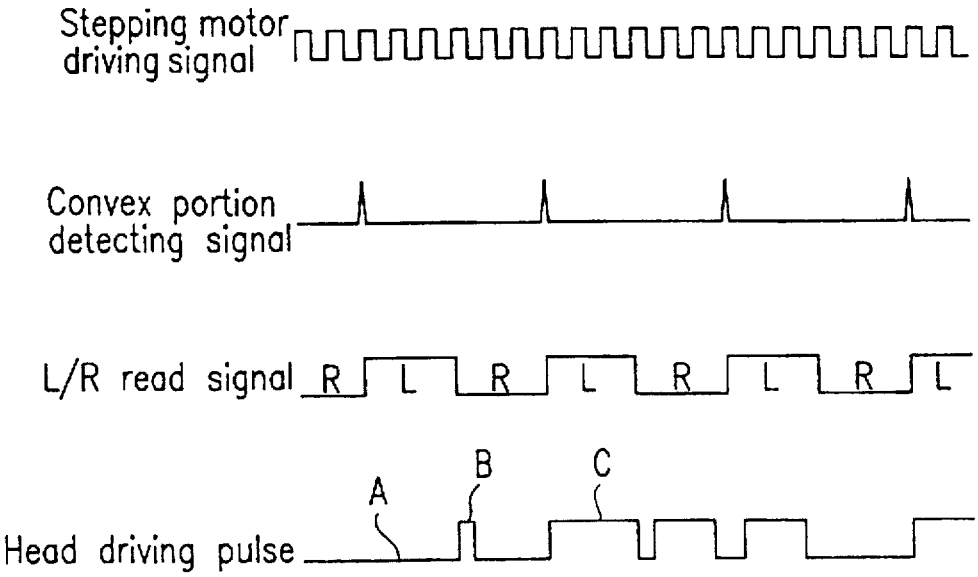
FIG. 10 is a timing diagram illustrating the operation timing of a printing head 4 and a roller driving section 11 illustrated in FIG. 2B.

FIG. 10 is a timing diagram illustrating a stepping motor driving signal, a convex portion detecting signal (pitch detecting signal), an L/R read signal, and head driving pulses.

In FIG. 10, the switching cycle of data reading is equal to a half of the cycle of the pitch detecting signal.

The pulse width of the head driving pulses varies in accordance with the data. The pulse width varies between all-OFF (i.e., remaining OFF during the entire period; indicated as A in FIG. 10), partially-ON (indicated as B in FIG. 10) and all-ON (i.e., remaining ON during the entire period; indicated as C in FIG. 10). As a result, the densities of the printed pixels are controlled accordingly.

The light path changing element 8 has a shape such that the upper and lower no-picture portions engage with the pinions 24*a* and 24*b*.

Figure 16:
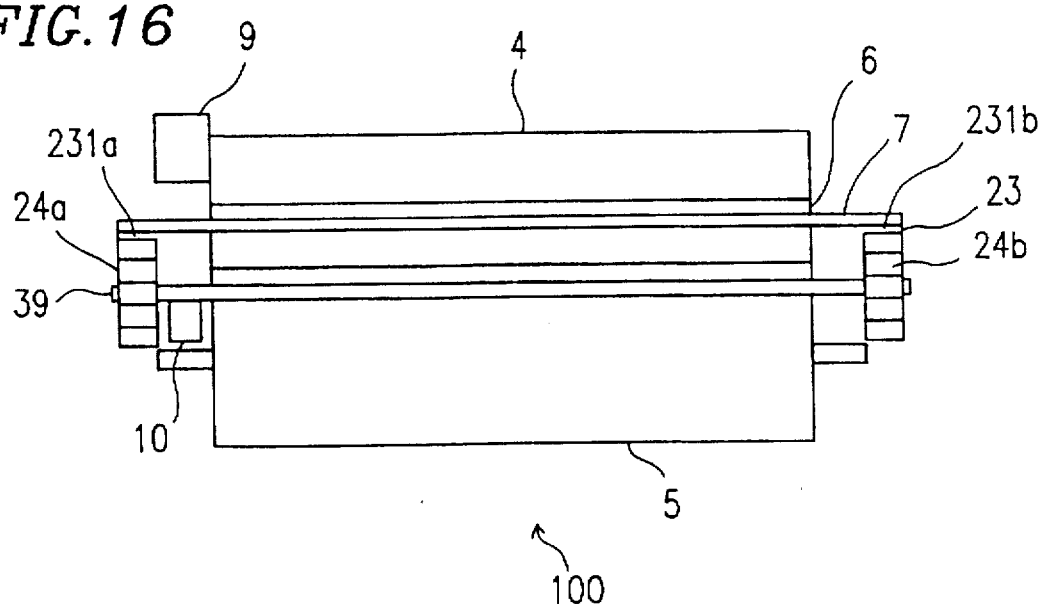
FIG. 16 is a side view illustrating the 3D image printing apparatus 100 as viewed from a B—B direction in FIG. 2A.

FIG. 16 is a side view illustrating the 3D image printing apparatus 100 as viewed from a B—B direction in FIG. 2A, showing the manner in which the light path changing element 8 engages with the pinions 24*a* and 24*b*. The upper no-picture portion of the light path changing element 8 is provided with a rack 231*a*, and the lower no-picture portion of the light path changing element 8 is provided with a rack 231*b*.

The pinion 24*a* engages with the rack 231*a*, and the pinion 24*b* engages with the rack 231*b*. A driving axis 39 is employed to simultaneously drive the pinions 24*a* and 24*b*.

Because of the driving axis 39, the pinions 24*a* and 24*b* are driven at the same circumferential speed as the feeding speed of the roller 5.

Figure 20A:
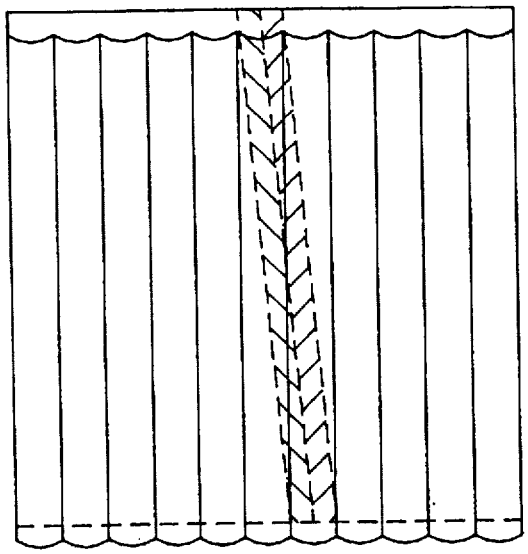
FIG. 20A is a diagram illustrating a state in which there is an offset in printing position between the upper and lower ends of a light path changing element.

In the conventional method for printing based on the detection of the concave and convex portions of a light path changing element (shown in FIG. 23), the direction of each stripe of the light path changing element (lenticular lens) 101 does not necessarily coincide with the direction of the printing head 114 (i.e., the axis direction of the roller 110). Therefore, the conventional method may produce an offset equal to a multiple of the pitch of the light path changing element between the upper and lower end of the light path changing element, as illustrated in FIG. 20A.

Figure 20B:
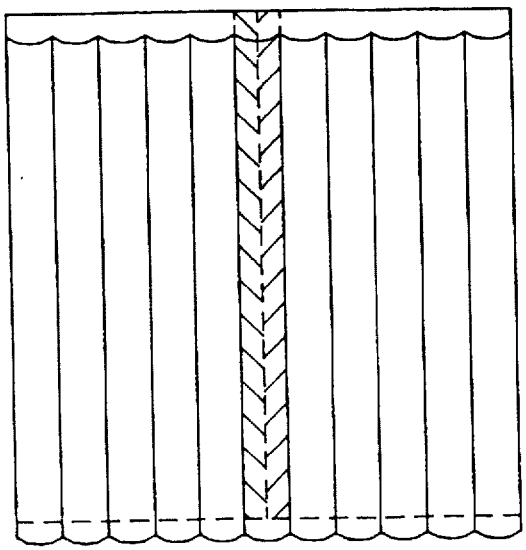
FIG. 20B is a diagram illustrating a state in which there is no offset in printing position between the upper and lower ends of a light path changing element.

On the other hand, according to the present example, an engagement mechanism employing the pinions 24*a* and 24*b* is provided upstream of the printing head 4 along the direction of travel of the light path changing element 8. As a result, it is ensured that the vertical direction of the light path changing element 8 (i.e., the direction in which one pitch of the stripe of the lens array 224 extends) coincides with one vertical line printed by the printing head 4. This prevents the occurrence of an offset equal to a multiple of the pitch of the light path changing element between the upper end lower end of the light path changing element as illustrated in FIG. 20A. As a result, as illustrated in FIG. 20B, image data corresponding to two vertical lines can be printed within the same stripe of the light path changing element 8 by the printing head 4.

When a viewer observes the light path changing element 8 with the dyeing layer 7 printed in the above-described manner at an appropriate distance, the viewer being situated on the side of the light path changing element 8 opposite to the dyeing layer 7, the right-eye image is only perceived by the viewer's right eye, and the left-eye image is only perceived by the viewer's left eye, whereby the viewer perceives the image as being three-dimensional.

As described above, in accordance with the present example, it is possible to relatively easily and quickly print a real image, a CG image, a synthesized image containing both, or an intermediate image generated from a real image (i.e., an image representing an inferred image between a left image and a right image) as a 3D image, as compared with conventional apparatuses of the same sort, by using an apparatus of a moderate scale.

The adjustment of a position to be printed on the light path changing element 8 is not limited to what has been described in the present example. A mechanical means as exemplified in FIG. 11, or a means for receiving reflected light as exemplified in FIG. 12 can also provide the same effect with a moderate-scaled structure, and such a configuration is also intended to be encompassed by the present invention.

Figure 11:
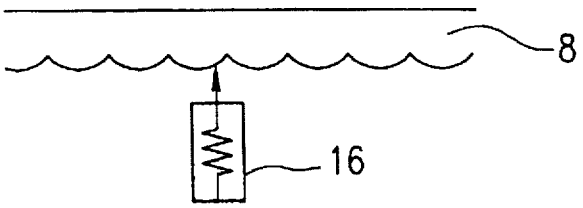
FIG. 11 is a diagram illustrating a method for detecting the pitch of a light path changing element using a probe.

FIG. 11 illustrates a probing device 16 for detecting the concave portions and convex portions of the light path changing element 8. By detecting the concave portions and convex portions of the light path changing element 8, and switching data at a cycle which is twice as large as the cycle of the detected convex (or concave) portions described above, it becomes possible to print pixel data for left and right eyes such that the data accurately corresponds to 1 pitch of the light path changing element 8.

It will also be appreciated that similar effects can be obtained by detecting both the concave portions and the convex portions of the light path changing element 8.

Figure 12:
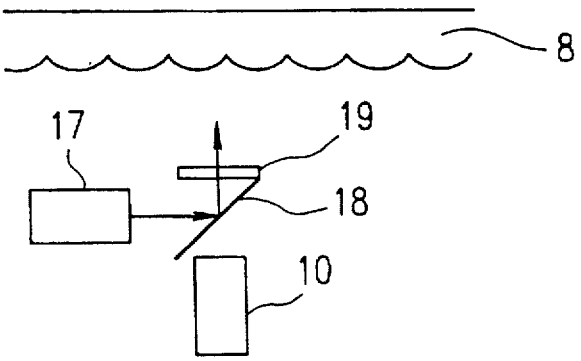
FIG. 12 is a diagram illustrating a method for detecting the convex portions of a light path changing element (of a reflection type) using a light emitting section and a light receiving section.

FIG. 12 shows a deflecting laser light source 17, a half mirror 18, a ¼ wavelength plate 19. The deflecting laser light emitted from the deflecting laser light source 17, reflected by the half mirror 18, is received by a light receiving section 10, whereby the peak values of the received light intensity are detected. As a result, printing positioning effects similar to those of the transmission type configuration described in the present example can be attained.

When conducting a plurality of printings for a color image, structures similar to the pinions 24*a* and 24*b* can be provided at the rear (i.e., downstream) of the roller 5, so that the feeding direction can be reversed for each respective color. Since the pinions 24*a* and 24*b* engage with the light path changing element 8, any offset between the upper and lower end of the lenticular lens (shown in FIG. 20A) or any offset between respective data of cyan, magenta, and yellow corresponding to the same coordinates can be eliminated. As a result, the image quality improves.

Figure 19:
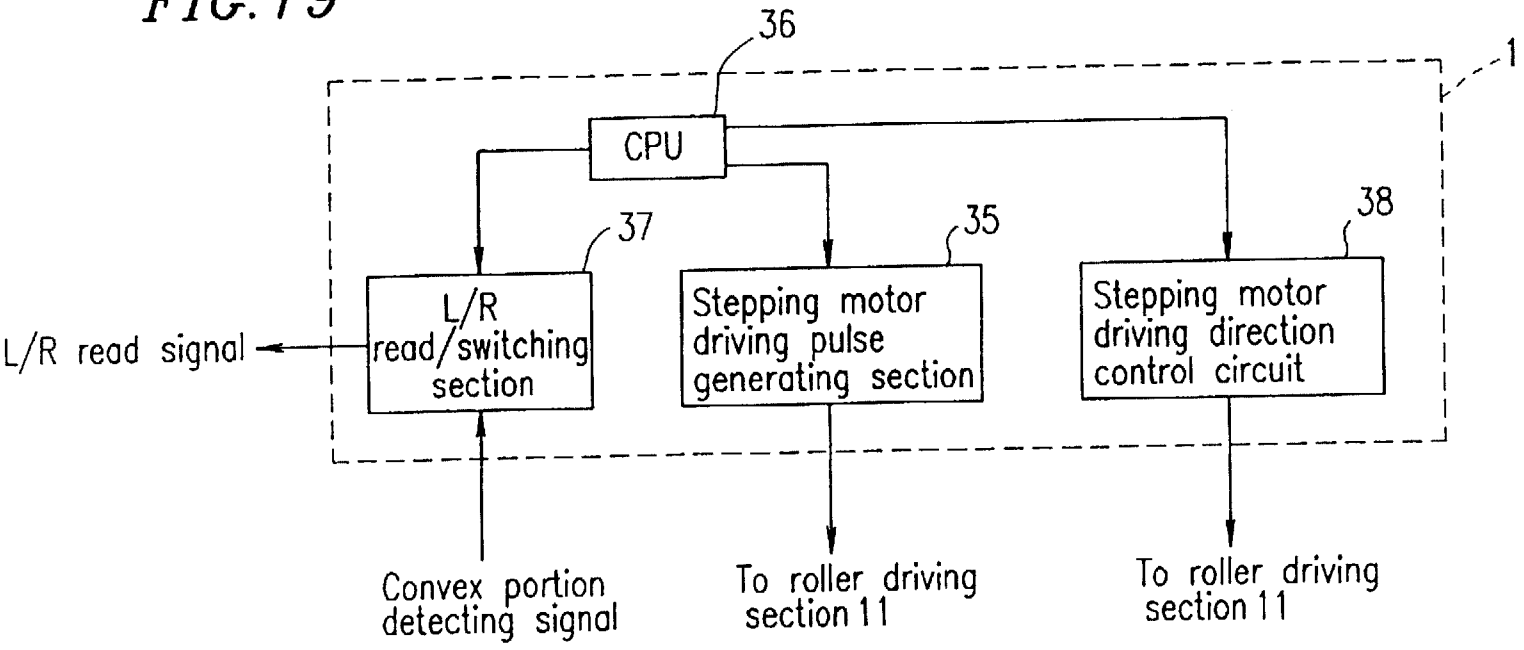
FIG. 19 is a diagram illustrating the configuration of a control circuit 1 in the case of printing a color image.

FIG. 19 illustrates an exemplary configuration of the control circuit 1 when printing a 3D image in a plurality of colors. As illustrated in FIG. 19, the control circuit 1 includes a CPU 36, an L/R read/switching section 37, a stepping motor driving pulse generating section 35 and a stepping motor driving direction control circuit 38. In FIG. 19, the stepping motor driving pulse generating section is indicated by the same reference numeral 35 as the stepping motor driving pulse generating section 35 in FIG. 17 because both performs the same function.

The CPU 36 outputs an operation control signal indicating the beginning or end of an operation to the L/R read/switching section 37 and the stepping motor driving pulse generating section 35. The CPU 36 also instructs the stepping motor driving direction control circuit 38 of an alternating driving direction for the respective printings conducted for cyan, magenta, and yellow.

For each printing of cyan, magenta, and yellow, the L/R read/switching section 37 switches the L/R reading order in accordance with the instruction for the stepping motor driving direction control circuit 38, that is, whether to proceed in the order "R" "L" "R" "L", etc. (as in the present example) or in the order "L" "R" "L" "R", etc (opposite to the driving direction in the present example). The stepping motor driving direction control circuit 38 drives the stepping motor in the direction instructed by the CPU 36.

(EXAMPLE 2)

Figure 13:
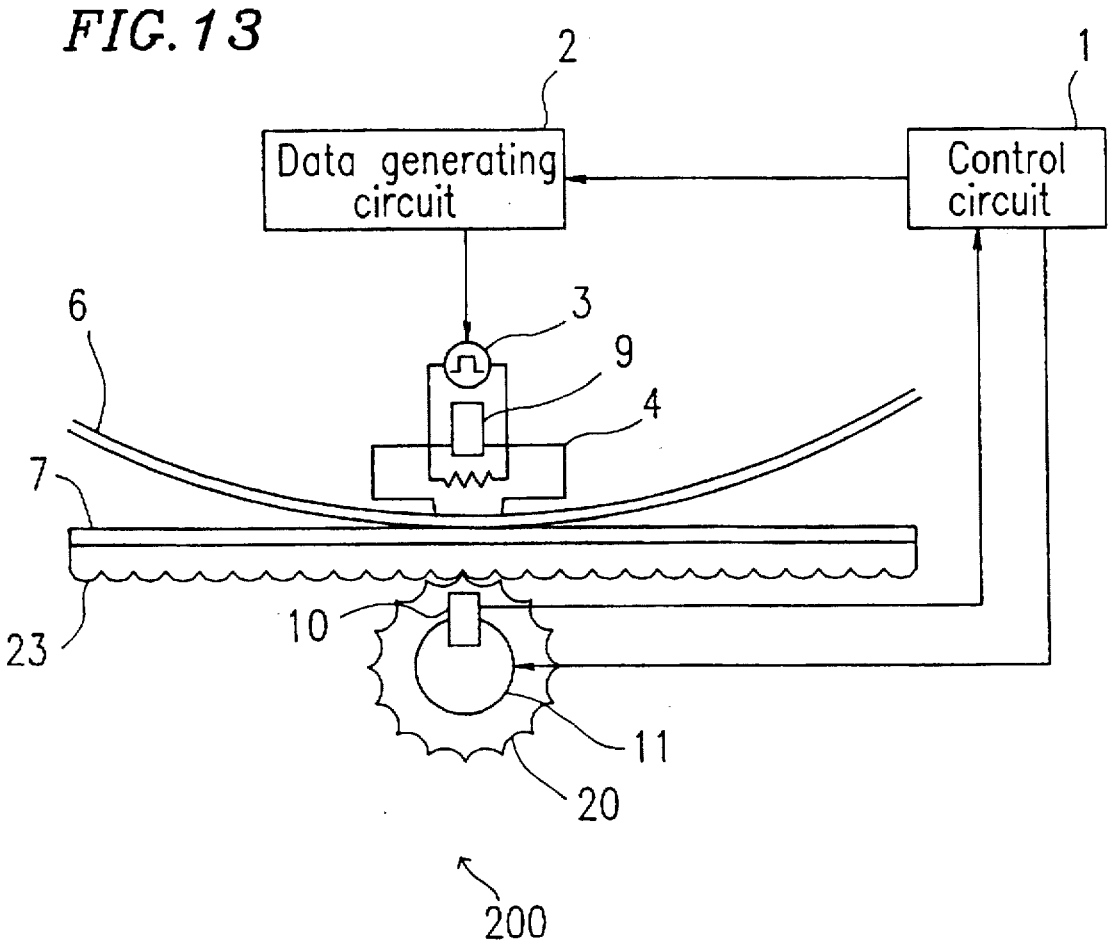
FIG. 13 is a side view illustrating a 3D image printing apparatus 200 according to the present invention.

FIG. 13 is a side view illustrates a 3D image printing apparatus 200 according to the present invention. The 3D image printing apparatus 200 prints image data on a light path changing element 23.

The structure of the light path changing element 23 is the same as that of the light path changing element 8 shown in FIGS. 1A and 1B except that the racks 231*a* and 231*b* are not provided for the light path changing element 23. The light path changing element 23 has a cross section with concave and convex portions periodically alternating along the direction in which the light path changing element 23 is conveyed.

The structure of the 3D image printing apparatus 200 is the same as that of the 3D image printing apparatus 100 shown in FIGS. 2A and 2B except for a roller 20. Constituent elements in FIG. 13 which also appear in FIGS. 2A and 2B are indicated by the same reference numerals as used therein, and the descriptions thereof are omitted.

The 3D image printing apparatus 200 does not have the pinions 24*a* and 24*b* shown in FIGS. 2A and 2B. The roller 20 has two functions: conveying the light path changing element 23; and adjusting a relative position of the light path changing element 23 with respect to the printing head 4 by engaging with the concave and convex portions of the light path changing element 23.

As illustrated in FIG. 13, the roller 20 has a pinion-like shape which engages with the concave portions and convex portions of the light path changing element 23. As a result of the engagement between the roller 20 and the concave portions and convex portions of the light path changing element 23, it becomes possible to ensure that the vertical direction of the light path changing element 23 (i.e., the direction in which one pitch of the stripe of the lens array 224 extends) coincides with the direction of the printing head 4 (i.e., the axis direction of the roller 20). The printing head 4 is driven so that two vertical lines of image data are printed within the same stripe of the light path changing element 23.

FIGS. 20A and 20B show the relationship between the concave portions and convex portions of a light path changing element and the positions of printed image data (indicated by oblique lines).

Figure 23:
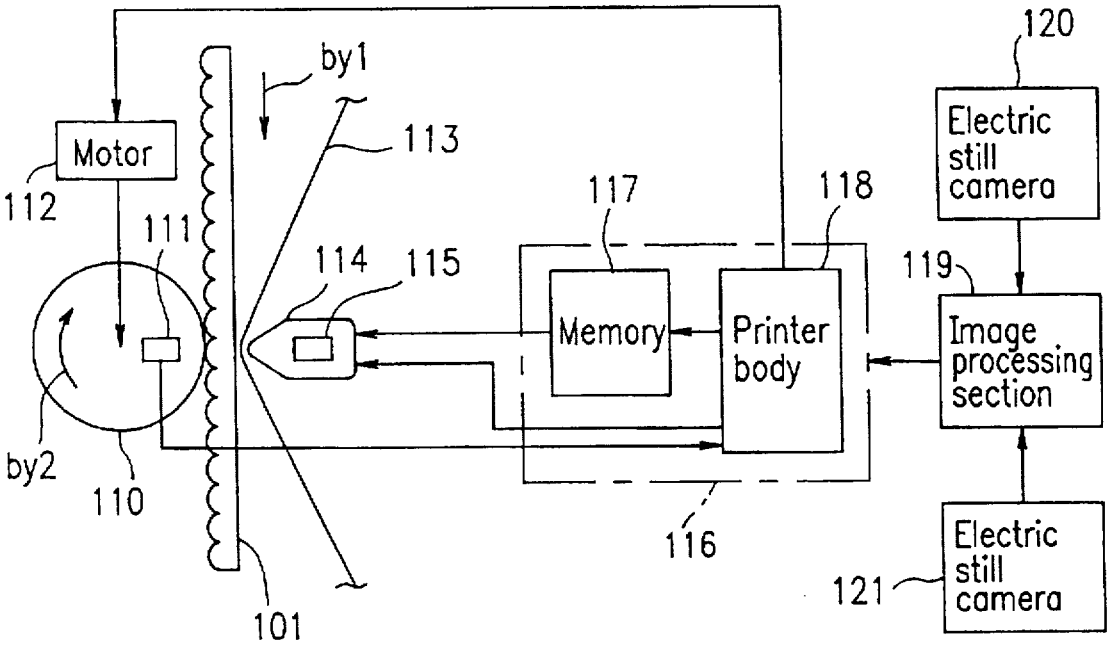
FIG.23 PRIOR ART
FIG. 23 is a diagram illustrating the configuration of a conventional prior art 3D image printing apparatus.
Figure 24:
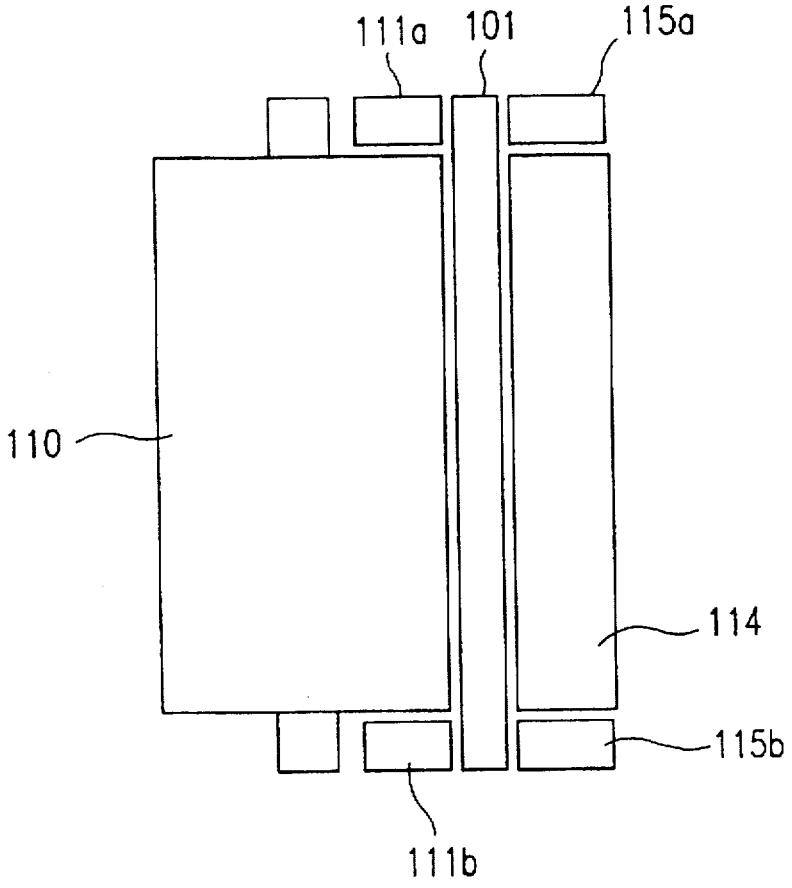
FIG. 24 PRIOR ART
FIG. 24 is a plan view illustrating the configuration of a conventional prior art 3D image printing apparatus.
Figure 25A:
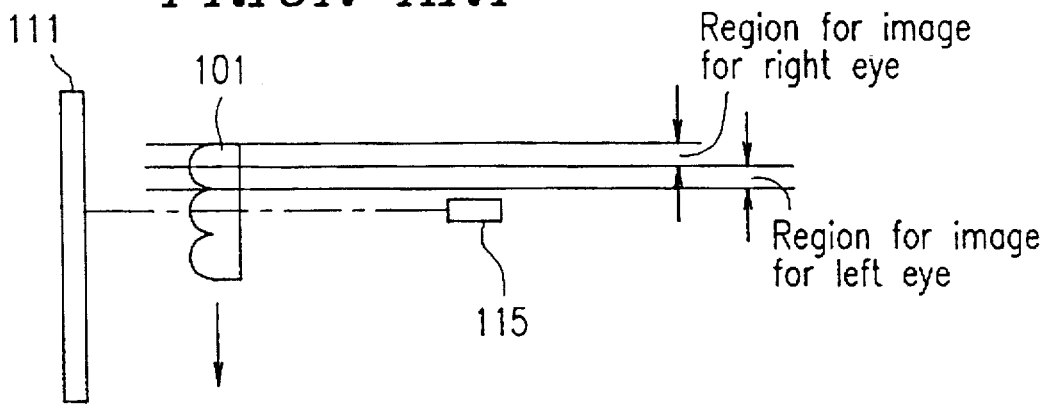
FIG. 25A PRIOR ART
FIG. 25A is a diagram illustrating a method for detecting a printing position in a conventional 3D image printing apparatus.
Figure 25B:
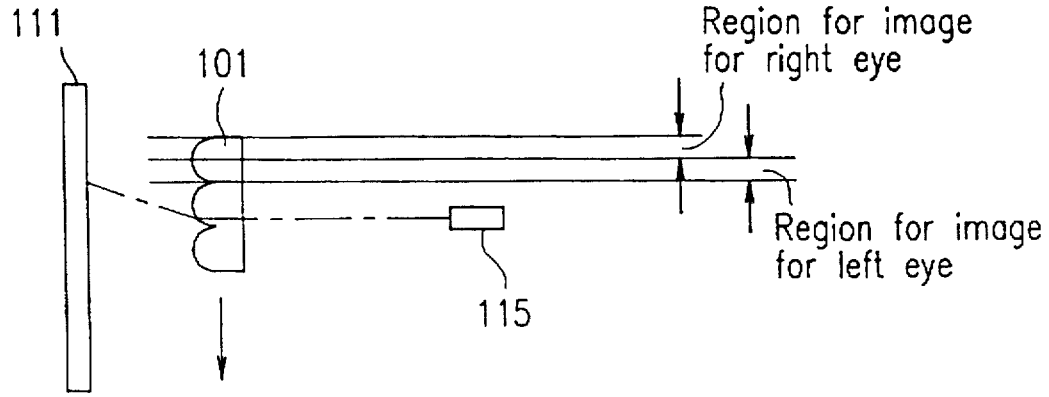
FIG. 25B PRIOR ART
FIG. 25B is a diagram illustrating a method for detecting a printing position in a conventional 3D image printing apparatus.

In the conventional method illustrated in FIG. 23, the direction of each stripe of the light path changing element (lenticular lens) 101 does not necessarily coincide with the direction of the printing head 114 (i.e., the axis direction of the roller 110). Therefore, the conventional method may produce an offset equal to a multiple of the pitch of the light path changing element between the upper and lower end of the light path changing element, as illustrated in FIG. 20A.

On the other hand, according to the present example, the roller 20 engages with the concave portions and convex portions of the light path changing element 23, so that the vertical direction of the light path changing element 23 (i.e., the direction in which one pitch of the stripe of the lens array 224 extends) always coincides with the direction of the printing head 4 (i.e., the axis direction of the roller 20). As a result, as illustrated in FIG. 20B, two vertical lines of image data are printed within the same stripe of the light path changing element 23 by the printing head 4 without fail.

Thus, according to the present example, the vertical direction of the light path changing element 23 (i.e., the direction in which one pitch of the stripe of the lens array 224 extends) coincides with the direction of each vertical line printed by the printing head 4. As a result, two vertical lines of image data are accurately printed within 1 pitch of the light path changing element 23 by the printing head 4.

When printing a color image on the light path changing element 23, it is necessary to separately print a plurality of image data on the same light path changing element 23, each image data being in a different color. In such color printing, the engagement between the roller 20 and the light path changing element 23 eliminates any offset between respective data of cyan, magenta, and yellow corresponding to the same coordinates, thereby improving the image quality.

The adjustment of relative position between the printing head 4 and the light path changing element 23 is not limited to what has been described in the present example. For example, a pinion shown in FIG. 14 can also achieve such positional adjustment. That is, the engagement between the pinion and the light path changing element provides the same effect.

(EXAMPLE 3)

Figure 14:
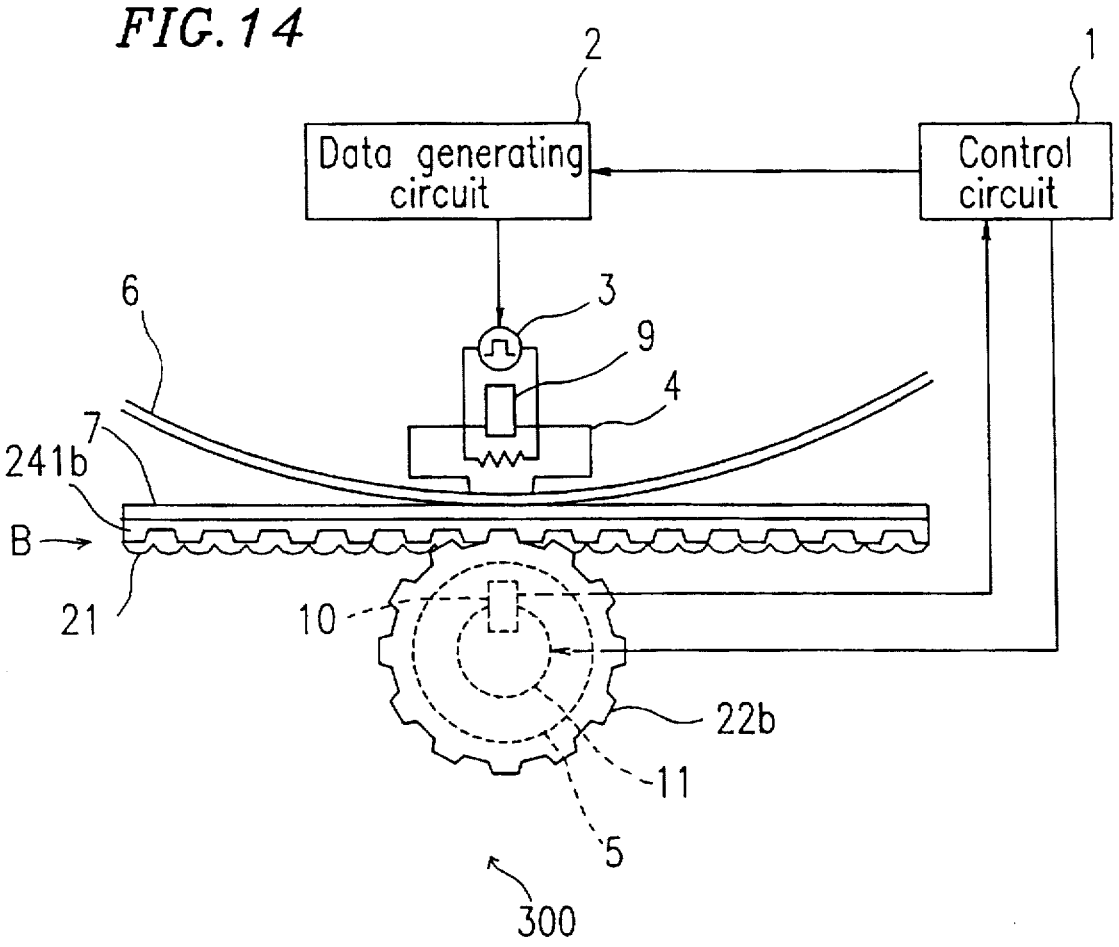
FIG. 14 is a side view illustrating a 3D image printing apparatus 300 according to the present invention.

FIG. 14 is a side view illustrating a 3D image printing apparatus 300 according to the present invention. The 3D image printing apparatus 300 prints image data on a light path changing element 21.

The structure of the light path changing element 21 is the same as that of the light path changing element 8 shown in FIGS. 1A and 1B except that racks 241*a* and 241*b* have a pitch different from that of the racks 231*a* and 231*b* of the light path changing element 8. The light path changing element 21 has the racks 241*a* and 241*b* extending along the direction in which the light path changing element 21 is conveyed.

The structure of the 3D image printing apparatus 300 is the same as that of the 3D image printing apparatus 100 shown in FIGS. 2A and 2B except for pinions 22*a* and 22*b*. Constituent elements in FIG. 14 which also appear in FIGS. 2A and 2B are indicated by the same reference numerals as used therein, and the descriptions thereof are omitted.

The 3D image printing apparatus 300 is provided with the pinions 22*a* and 22*b*, instead of the pinions 24*a* and 24*b* shown in FIGS. 2A and 2B. The pinions 22*a* and 22*b* function to adjust a relative position of the light path changing element 21 with respect to a printing head 4.

The pinion 22*a* engages with the rack 241*a* of the light path changing element 21, and the pinion 22*b* engages with the rack 241*b* of the light path changing element 21. The rotation axes of the pinions 22*a* and 22*b* are identical with the rotation axis of the roller 5, so that the pinions 22*a* and 22*b* are driven around the same rotation axis as that of the roller 5.

Figure 15:
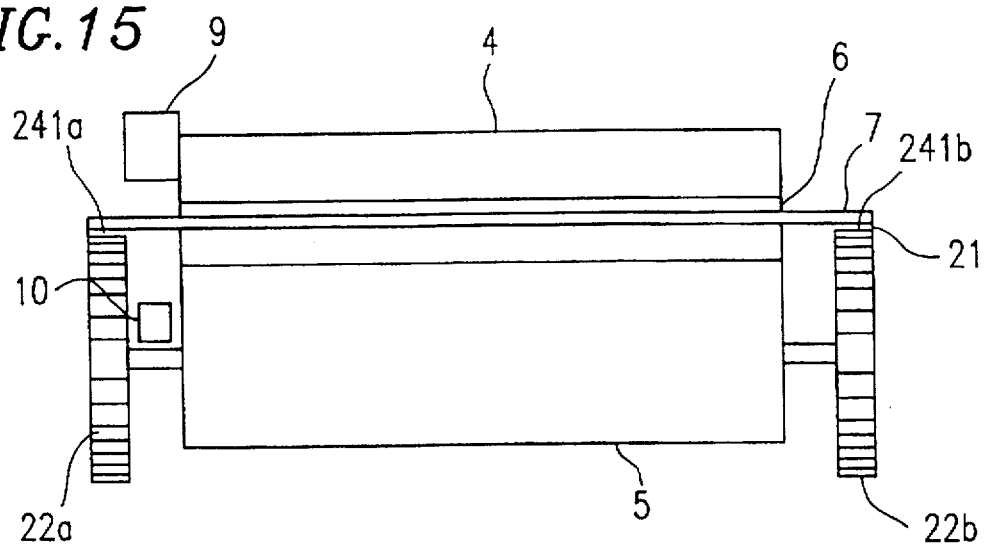
FIG. 15 is a side view illustrating the 3D image printing apparatus 300 as viewed form a direction B in FIG. 14.

FIG. 15 is a side view illustrating the 3D image printing apparatus 300 as viewed from a direction B in FIG. 14, showing the manner in which the light path changing element 21 engages with the pinions 22*a* and 22*b*.

The rack 241*a* is provided in the upper no-picture portion of the light path changing element 21, and the rack 241*b* is provided in the lower no-picture portion of the light path changing element 21. The pinion 22*a* engages with the rack 241*a*, and the pinion 22*b* engages with the rack 241*b*.

The pitch of the pinions 22*a* and 22*b* is prescribed to be larger than the pitch of the light path changing element 21. As a result, the light path changing element 21 is prevented from deviating from its appropriate position relative to the printing head 4 even when the light path changing element 21 is inserted into the 3D image printing apparatus 300 in a slightly shifted direction. Thus, the image data is effectively prevented from being shifted as in a state shown in FIG. 20A when printed on the light path changing element 21.

When printing a color image on the light path changing element 21, it is necessary to separately print a plurality of image data on the same light path changing element 21, each image data being in a different color. In such color printing, the engagement between the pinions 22*a* and 22*b* and the racks 241*a* and 241*b*, respectively, eliminates any offset between respective data of cyan, magenta, and yellow corresponding to the same coordinates, thereby improving the image quality.

By combining the roller shape and pinion mechanisms described in the above Examples, the printing head 4 can even more stably print two vertical lines of image data within 1 pitch of the light path changing element 21.

For example, structures similar to the pinions described in Example 1 can be provided at the rear (i.e., downstream) of the roller 5 as well as forward (i.e., upstream) thereof. As a result, the printing head can even more stably print two vertical lines of image data within 1 pitch of the light path changing element 21, from the beginning to the end of the printing. When printing a color image on the light path changing element 21, any offset between respective data of cyan, magenta, and yellow corresponding to the same coordinates can be eliminated, thereby improving the image quality.

Furthermore, similar effects can be obtained by arbitrarily combining the pinion mechanisms provided forward of the roller described in Example 1, the roller shape described in Example 2, and the pinion mechanisms described in Example 3.

(EXAMPLE 4)

When a sufficient accuracy is attained by combining one or more of the roller shapes and/or pinion mechanisms described in Examples 1 to 3 above, it is unnecessary to switch the read signal based on the detected concave portions or convex portions of the light path changing element; it is only necessary to switch the L/R read signal per every predetermined number of pulses. Such a configuration is exemplified in Example 4.

Figure 21:
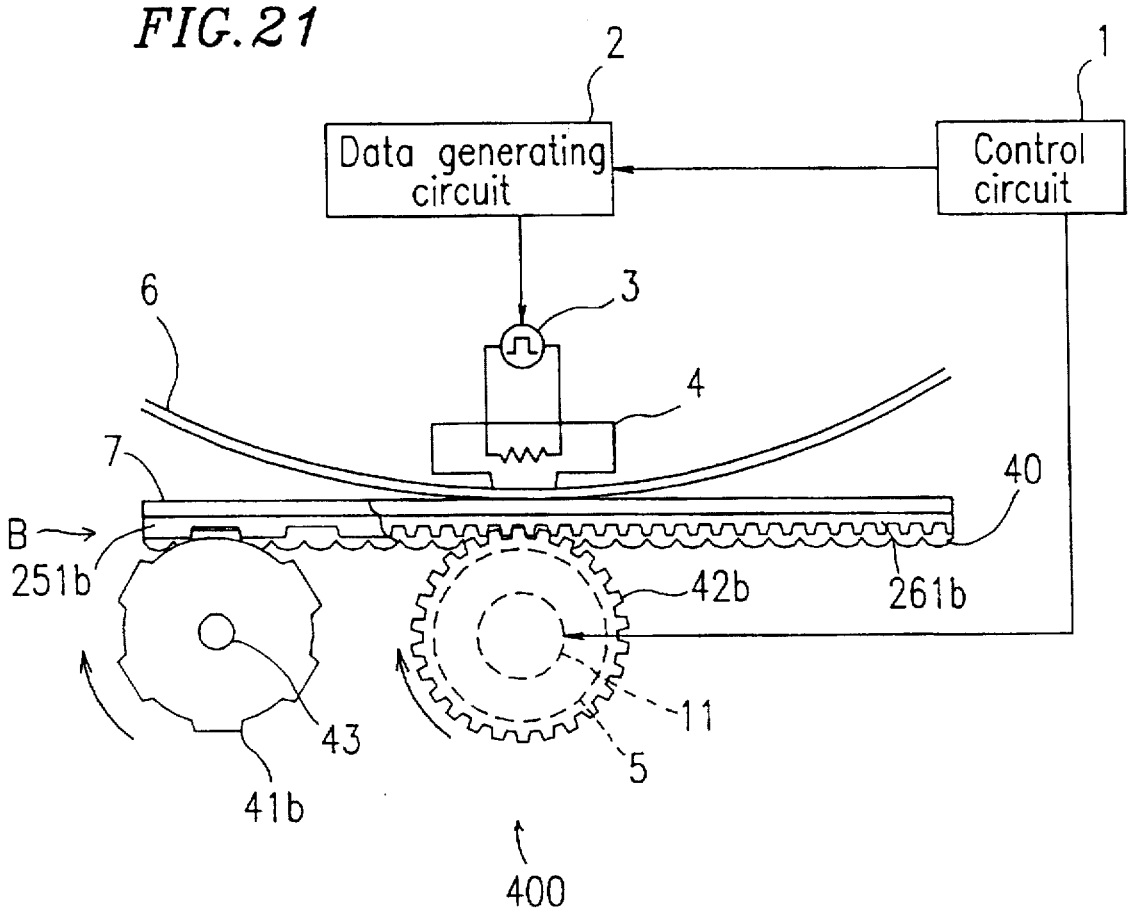
FIG. 21 is a side view illustrating a 3D image printing apparatus 400 according to the present invention.

FIG. 21 is a side view illustrating a 3D image printing apparatus 400 according to the prevent invention. The 3D image printing apparatus 400 prints image data on a light path changing element 40.

The structure of a light path changing element 40 is the same as that of the light path changing element 8 shown in FIGS. 1A and 1B except that racks 251*a* and 251*b* having a first pitch and racks 261*a* and 261*b* having a second pitch different from the first pitch are provided for the light path changing element 40.

The structure of the 3D image printing apparatus 400 is the same as that of the 3D image printing apparatus 100 shown in FIGS. 2A and 2B, except for pinions 41*a* and 41*b* and pinions 42*a* and 42*b*. Constituent elements in FIG. 21 which also appear in FIGS. 2A and 2B are indicated by the same reference numerals as used therein, and the descriptions thereof are omitted.

The pinion 41*a* engages with the rack 251*a* of the light path changing element 40, and the pinion 41*b* engages with the rack 251*b* of the light path changing element 40. The pinions 41*a* and 41*b* are driven at the same circumferential speed as that of the pinions 42*a* and 42*b* due to a driving axis 43.

The pinions 41*a* and 42*b* have the first pitch, which is prescribed to be larger than the pitch of the stripes of the light path changing element 40. As a result, the light path changing element 40 is prevented from deviating from its appropriate position relative to a printing head 4 even when the light path changing element 40 is inserted into the 3D image printing apparatus 400 in a slightly shifted direction. Thus, the image data is effectively prevented from being shifted as illustrated in FIG. 20A when printed on the light path changing element 40.

The pinion 42*a* engages with the rack 261*a* of the light path changing element 40, and the pinion 42*b* engages with the rack 261*b* of the light path changing element 40.

The pinions 42*a* and 42*b* have the second pitch, which is prescribed to be smaller than the pitch of the stripes of the light path changing element 40. This enables the light path changing element 40 to be accurately slid so that two vertical lines of image data can be printed within one stripe of the light path changing element 40 by the printing head 4. The sliding accuracy of the light path changing element 40 increases as the pitch of the pinions 42*a* and 42*b* decreases.

The pinion 41*a* is located upstream of the pinion 42*a* along the direction in which the light path changing element 40 is conveyed. Similarly, the pinion 41*b* is located upstream of the pinion 42*b* along the direction in which the light path changing element 40 is conveyed. It is preferable that the pitch of the pinion 41*a* is larger than 1.5 times the pitch of the pinion 42*a* and that the pitch of the pinion 41*b* is larger than 1.5 times the pitch of the pinion 42*b*.

The switching of the image data to be printed on the light path changing element 40 is performed based on stepping motor driving pulses output from the stepping motor driving pulse generating section 35 (FIG. 17). For example, the switching of image data can be conducted per every predetermined number of stepping motor driving pulses.

Figure 22:
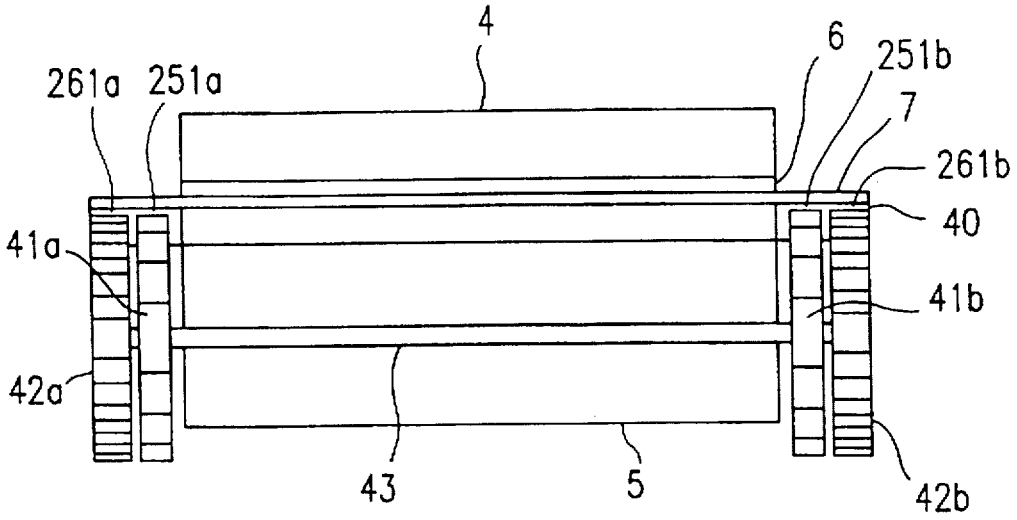
FIG. 22 is a side view illustrating the 3D image printing apparatus 400 as viewed from a direction B in FIG. 21.

FIG. 22 is a side view illustrating the 3D image printing apparatus 400 as viewed from a direction B in FIG. 21, showing the manner in which the light path changing element 40 engages with the pinions 41*a*, 41*b*, 42*a* and 42*b*.

The racks 251*a* and 261*a* are provided in the upper no-picture portion of the light path changing element 40, and the racks 251*b* and 261*b* are provided in the lower no-picture portion of the light path changing element 40. The pinion 41*a* engages with the rack 251*a*, and the pinion 41*b* engages with the rack 251*b*. The pinion 42*a* engages with the rack 261*a*, and the pinion 42*b* engages with the rack 261*b*.

Thus, by providing a pinion mechanism having a pitch larger than the pitch of the stripes of the light path changing element 40, any offset equal to a multiple of the pitch of the light path changing element 40 between the upper and lower end thereof is prevented from occurring when printing images on the light path changing element 40. Moreover, by providing a pinion mechanism having a pitch smaller than the pitch of the stripes of the light path changing element 40, the light path changing element 40 can be slid with high accuracy. This makes it unnecessary to detect the concave portions and convex portions of the light path changing element 40. In accordance with the 3D image printing apparatus 400, it is possible to print two vertical lines of image data within one stripe of the light path changing element 40, without detecting the concave portions and convex portions of the light path changing element 40.

(EXAMPLE 5)

In the present example, only one rack is provided in the no-picture portions of the light path changing element.

Figure 26:
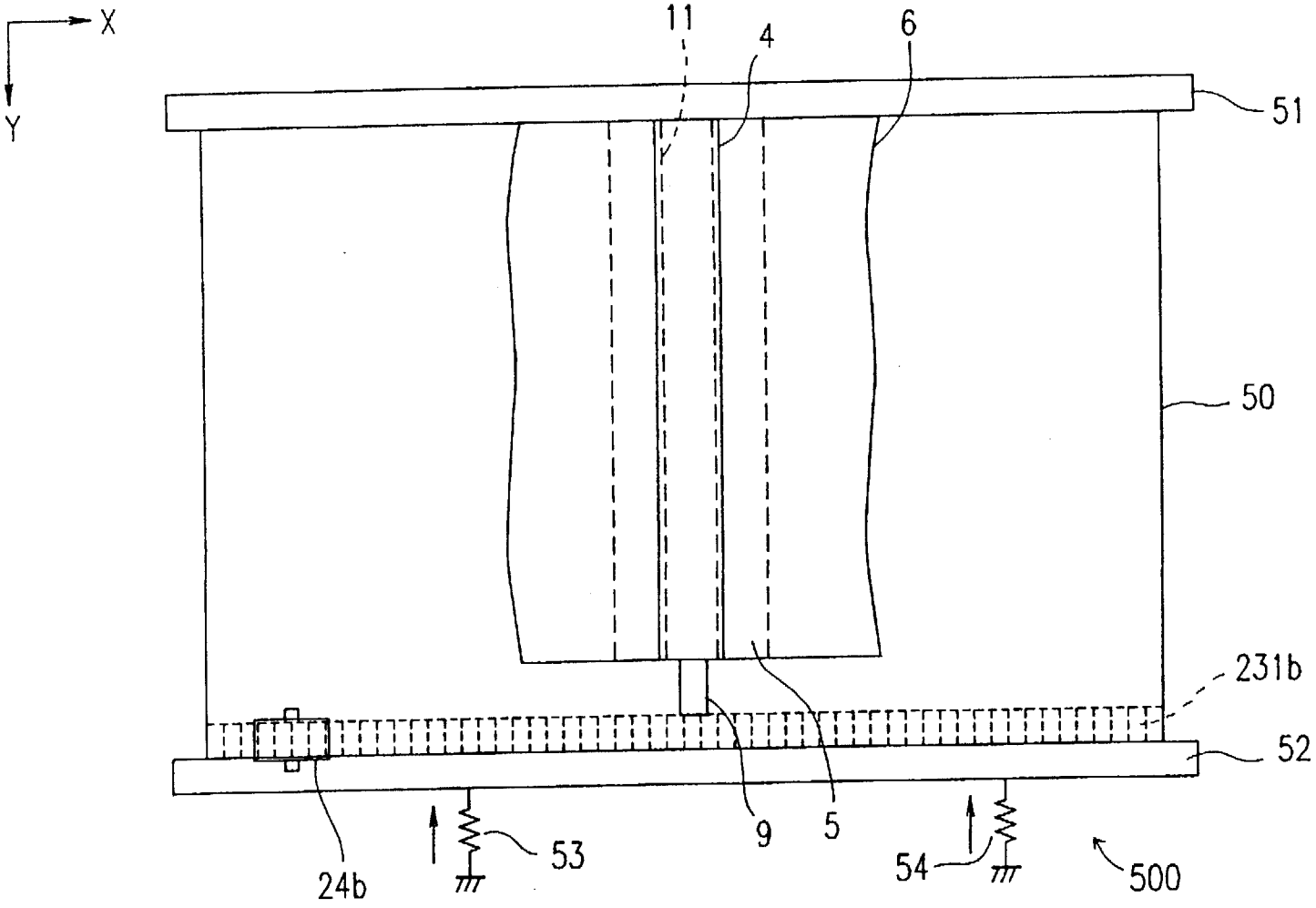
FIG. 26 is a plan view illustrating a 3D image printing apparatus 500 according to the present invention.

FIG. 26 is a top view illustrating the 3D image printing apparatus 500. The 3D image printing apparatus 500 prints image data on a light path changing element 50.

The light path changing element 50 includes a rack 231*b* extending along an X direction.

The 3D image printing apparatus 500 includes a pinion 24*b*, which engages with the rack 231*b*.

In the place of the pinion mechanism including the rack 231*a* an the pinion 24*a* shown in FIGS. 2A and 2B, a positioning member 51 and a pressuring member 52 are provided in the 3D image printing apparatus 500. The positioning member 51 is fixed to the 3D image printing apparatus 500 so that the light path changing element 50 slides along the X direction. Elastic members such as springs (53, 54) are connected to the pressuring member 52. The pressuring member 52 functions to pressure the light path changing element 50 against the positioning member 51 along the Y direction.

In accordance with the above configuration, the image data to be printed on the light path changing element 50 can be prevented from being dislocated.

By incorporating the positioning member 51 and the pressuring member 52 of the prevent example into any one of the 3D image printing apparatuses described in Examples 1 to 4, the pinion(s) and the rack(s) on one side can be omitted.

(EXAMPLE 6)

Figure 27:
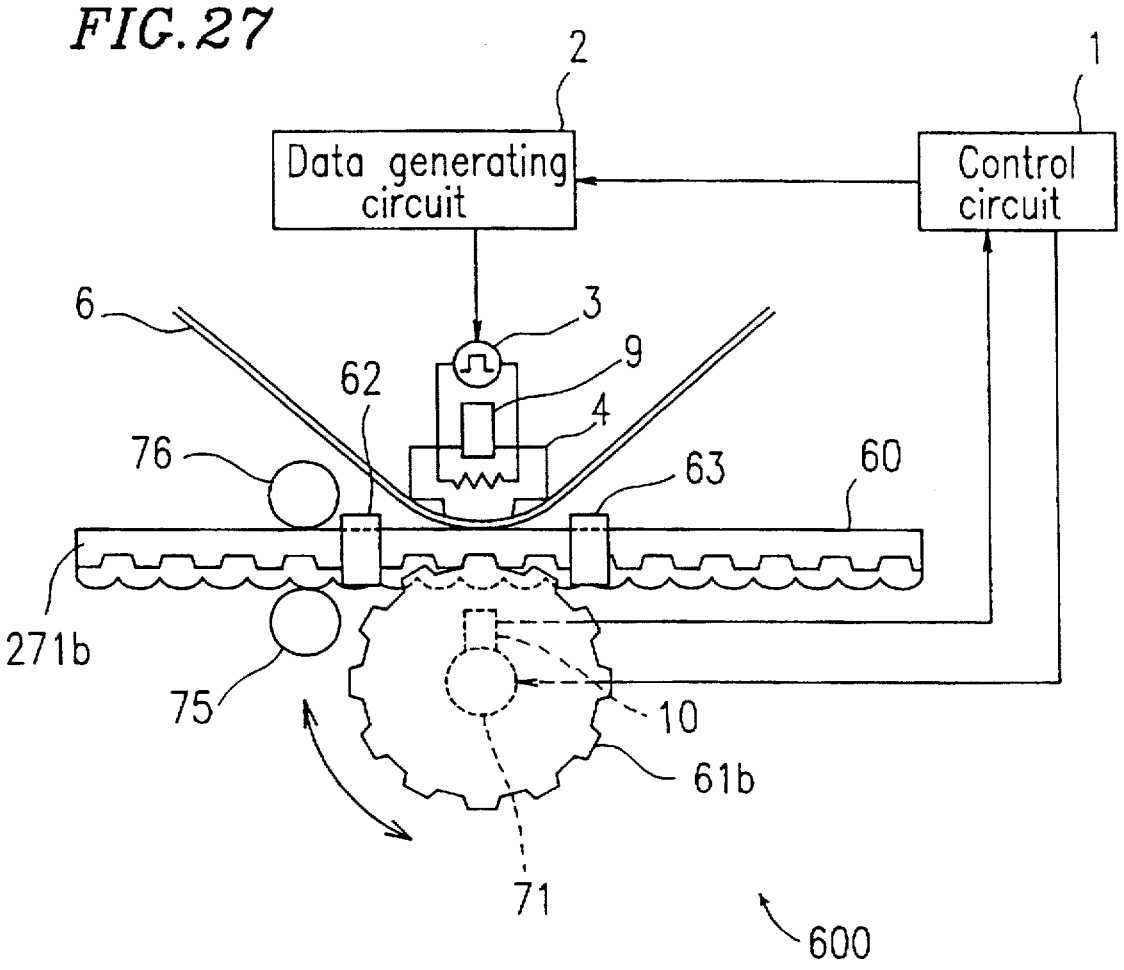
FIG. 27 is a side view illustrating a 3D image printing apparatus 600 according to the present invention.

FIG. 27 is a side view illustrating a 3D image printing apparatus 600 according to the present invention. The 3D image printing apparatus 600 prints image data on a light path changing element 60.

The 3D image printing apparatus 600 includes a maintaining mechanism for maintaining the engagement between a pinion 61*a* and a rack 271*a* of the light path changing element 60 and the engagement between a pinion 61*b* and a rack 271*b* of the light path changing element 60 irrespective of the position of a printing head 4. When printing a color image, it is necessary to move the printing head 4 along the vertical direction in order to separately print a plurality of different image data on the same light path changing element 60. The purpose of the maintaining mechanism is to prevent the light path changing element 60 from dropping off the 3D image printing apparatus 600 during such movements of the printing head 4.

Figure 28:
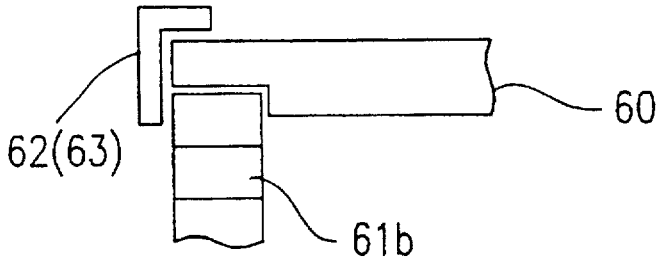
FIG. 28 is a view illustrating the relative positions of guides 62 (63) and a pinion 61*b*.

The maintaining mechanism includes guides 62 and 63. The guides 62 and 63 are fixed to the 3D image printing apparatus 600. The light path changing element 60 is interposed between the guide 62 and the pinion 61*b*, and between the guide 63 and the pinion 61*b*. As a result, even when the printing head 4 rises in position and is away from the light path changing element 60, the light path changing element 60 is prevented from being detached from the pinions 61*a* and 61*b*. As illustrated in FIG. 28, it is preferable that each of the guides 62 and 63 has an L-shape.

A pinion driving section 71 drives the pinions 61*a* and 61*b*. Rollers 75 and 76 are employed to convey the light path changing element 60 in the forward or reverse direction.

In order to achieve good conveyance of the light path changing element 60, the rotation axis of the pinion driving section 71 and the rotation axes of the rollers 75 and 76 are preferably disposed as close to one another as possible along the direction in which the light path changing element 60 is conveyed.

Similarly, the rotation axis of the pinion driving section 71 and the guides 62 and 63 are preferably disposed as close to one another as possible along the direction in which the light path changing element 60 is conveyed.

Figure 29:
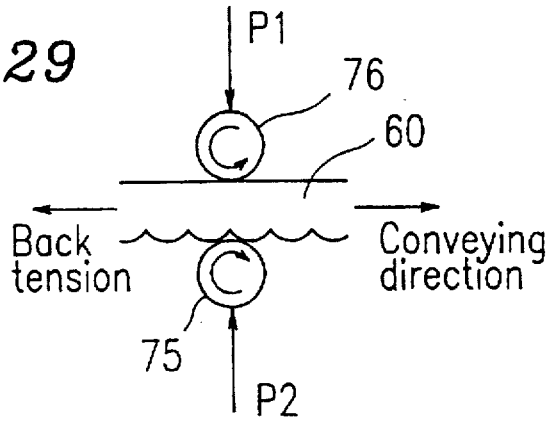
FIG. 29 is a view illustrating the manner in which back tension occurs.
Figure 30:
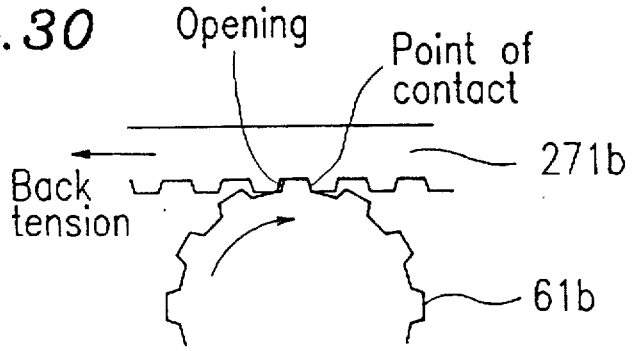
FIG. 30 is a view illustrating the relative positions of a pinion 61*b* and a rack 271*b*.

It is not necessary to drive the rollers 75 and 76. In the case where the rollers 75 and 76 are driven, it is preferable to prescribe the feed amount of the rollers 75 and 76 to be equal to or smaller than the feed amount of the pinion mechanism and to use rollers containing a fluorine-type resin so that back tension is provided. In the case where the rollers 75 and 76 are not driven, it is preferable to provide back tension by pressing the light path changing element 60 with appropriate force (P1 and P2) (FIG. 29). When back tension is created, each pinion engages with its associated rack in a uniform manner (FIG. 30), thereby improving the conveyance accuracy.

In FIG. 27, a light emitting section 9 and a light receiving section 10 can be reversed in position.

In any of the above-described Examples, it is possible to print a 3D image in a plurality of colors by performing an appropriate printing operation for each of cyan, magenta, and yellow.

By performing a printing for cyan, magenta, and yellow each as described above, it becomes possible to easily adjust the positions of respective images in three colors, whereby a 3D image can be printed in colors.

Specifically, a color printing of a 3D image can be achieved in the following manner: After a first printing is connected in cyan, the head is lifted, and the light path changing element 60 is conveyed in a reverse direction to the printing beginning position. Next, a second printing is conducted in magenta, and thereafter the head is lifted, and the light path changing element 60 is conveyed in the reverse direction to the printing beginning position. Finally, a third printing is conducted in yellow.

Although the printing of stereoscopic 3D images was described in the above Examples for conciseness, the prevent invention also encompasses printing of multi-view point 3D images. The present invention is also applicable to the case where the image is taken in only one direction. For example, the 3D image printing apparatus of the present invention can be employed to print a plurality of images taken at different times within 1 pitch of stripes of a light path changing element.

The image output from the 3D image printing apparatus according to any Example of the present invention is not limited to images which were actually filmed, photographed, etc. The image includes, for example, a CG image, a real image, a synthesized image containing both, or an intermediate image generated from a real image (i.e., an image representing an inferred image between a left image and a right image). The image output from the 3D image printing apparatus of the present invention can be used for printing any of such a variety of images on a light path changing element.

In any of the above Examples, the light path changing element includes a dyeing layer attached on one face thereof. The material for the dyeing layer is preferably a transparent material, e.g., glass or crystal (glass).

It is also applicable to form the light path changing element of a dyeable material in an integral manner instead of employing the above-described structure including a dyeing layer attached on one face of the light path changing element. As a result, the number of steps and the cost for the production of the apparatus decrease, whereby the apparatus gains further convenience.

As a dyeable material, polymer materials which are dyeable with dispersion dyes are suitable. For example, polyester, polyacetal, acrylic resins, urethane resins, nylon resins, vinyl acetate resins, and butyral resins are preferable.

Especially useful among the above polymer materials are: acrylic resins, vinyl chloride resins and butyral resins because of their excellent dyeability. Furthermore, it is possible to form a light path changing element of a material containing a plurality of such dyeable materials.

In any example of the present invention, the contrast of the obtained 3D image can be improved by, for example, applying paper or paint onto the back face of the light path changing element on which an image has been printed, the paper or paint serving as a back substrate for intercepting or attenuating light transmitted through the light path changing element when observed.

In any example of the present invention, it is possible to observe a 3D image created by light transmitted through the printed light path changing element, with a light source disposed behind the light path changing element.

Thus, according to the present invention, a 3D image can be printed relatively easily and quickly with an apparatus of a moderate scale, as compared with conventional apparatuses of the same sort. Specifically, by employing one or more of a roller having concave portions and convex portions and a pinion mechanism, two vertical lines of image data can be printed within 1 pitch of stripes of a light path changing element.

By providing a pinion mechanism having a pitch larger than the pitch of the stripes of the light path changing element, any offset equal to a multiple of the pitch of the light path changing element between the upper and lower end thereof is prevented from occurring when printing images on the light path changing element. By providing a pinion mechanism having a pitch smaller then the pitch of the stripes of the light path changing element, the light path changing element can be slid highly accurately. This makes it unnecessary to detect the concave portions and convex portions of the light path changing element by using a feedback system. In accordance with the 3D image printing apparatus of the present invention, it is possible to print two vertical lines of image data within one stripe of the light path changing element without detecting the concave portions and convex portions of the light path changing element.

Even in the case of employing a simplified mechanism for sliding the light path changing element, it is possible to print two vertical lines of image data within one stripe of the light path changing element by detecting the concave portions and convex portions of the light path changing element using a simple feedback system.

The image output from the 3D image printing apparatus according to the present invention is not limited to images which were actually filmed, photographed, etc. The image includes, for example, a CG image, a real image, a synthesized image containing both, or an intermediate image generated from a real image (i.e., an image representing an inferred image between a left image and a right image). The image output from the 3D image printing apparatus of the present invention can be used for printing such various images on a light path changing element.

Furthermore, in the case of printing a color image on a light path changing element, any offset among pixels occurring in a plurality of printings of different image data can be minimized, thereby improving the image quality.

Various other modifications will be apparent to and can be readily made by those skilled in the art without departing from the scope and spirit of this invention. Accordingly, it is not intended that the scope of the claims appended hereto be limited to the description as set forth herein, but rather than the claims be broadly construed.

What is claimed is:

1. An apparatus for printing image data on a lens array having a plurality of lenses arranged along a first direction, the apparatus comprising:

image data generating means for generating image data;

a head having a plurality of printing elements arranged along a second direction, the head driving each of the plurality of printing elements in accordance with the image data;

conveying means for conveying the lens array relative to the head; and a first pinion and a second pinion which are arranged along the second direction, wherein the first pinion and the second pinion each having a rotation axis parallel to the second direction, and the lens array has a first rack extending along the first direction and a second rack extending along the first direction, the first pinion engaging with the first rack of the lens array and the second pinion engaging with the second rack of the lens array.

2. An apparatus according to claim 1, wherein the conveying means includes a roller rotating around a rotation axis, at least a portion of the roller being in contact with the lens array.

3. An apparatus according to claim 2, wherein the roller is rotated so that back tension is created between the roller and the lens array.

4. An apparatus according to claim 2, wherein the rotation axis of the first pinion and the rotation axis of the second pinion are identical with the rotation axis of the roller.

5. An apparatus according to claim 1, further comprising:

a third pinion and a fourth pinion arranged along the second direction, the third pinion and the fourth pinion each having a rotation axis parallel to the second direction, wherein the lens array includes a third rack extending along the first direction and a fourth rack extending along the first direction;

the third pinion engages with the third rack of the lens array and fourth pinion engages with the fourth rack of the lens array; and a pitch of the third pinion is larger than a pitch of the first pinion, and a pitch of the fourth pinion is larger than a pitch of the second pinion.

6. An apparatus according to claim 5, wherein the pitch of the third pinion is larger than 1.5 times the pitch of the first pinion, and the pitch of the fourth pinion is larger than 1.5 times the pitch of the second pinion.

7. An apparatus according to claim 5, wherein the third pinion is located upstream of the first pinion along a direction in which the lens array is conveyed, and the fourth pinion is located upstream of the second pinion along the direction in which the lens array is conveyed.

8. An apparatus according to claim 1, further comprising:

detecting means for detecting a position of the lens array relative to a position of the head, wherein the image data generated by the image data generating means includes a first portion and a second portion, the image data generating means selectively outputting the first portion or the second portion included in the image data in accordance with an output of the detecting means.

9. An apparatus according to claim 1, further comprising:

maintaining means for maintaining the engagement between the first pinion and the first rack of the lens array and the engagement between the second pinion and the second rack of the lens array irrespective of a position of the head.

10. An apparatus according to claim 9, wherein the maintaining means includes a first member and a second member which are fixed with respect to the lens array, the lens array being interposed between the first member and the first pinion and between the second member and the second pinion.

11. An apparatus according to claim 1, wherein the image data is image data which is obtained by taking images in a virtual manner or in an actual manner.

12. An apparatus according to claim 1, wherein the lens array includes a dyeing layer, and the head causes ink of an ink sheet to adhere to the dyeing layer of the lens array.

13. An apparatus according to claim 12, wherein a back substrate is applied onto a back face of the lens array after the image data is printed on the lens array, thereby intercepting light transmitted through the lens array from the back face when the lens array is observed.

14. An apparatus according to claim 1, wherein the lens array is integrally formed of a dyeable material.

15. An apparatus according to claim 14, wherein the dyeable material includes at least one of an acrylic resin, a vinyl chloride resin and a butyral resin.

16. An apparatus for printing image data on a lens array having a plurality of lenses arranged along a first direction, the apparatus comprising:

image data generating means for generating image data;

a head having a plurality of printing elements arranged along a second direction, the head driving each of the plurality of printing elements in accordance with the image data;

conveying means for conveying the lens array relative to the head;

a pinion having a rotation axis parallel to the second direction; and pressuring means for pressuring the lens array along the second direction, wherein the lens array includes a rack extending along the first direction, the pinion engaging with the rack of the lens array.

* * * * *